US007627393B2

(12) United States Patent
Sawodny et al.

(10) Patent No.: US 7,627,393 B2
(45) Date of Patent: Dec. 1, 2009

(54) CRANE OR DIGGER FOR SWINGING A LOAD HANGING ON A SUPPORT CABLE WITH DAMPING OF LOAD OSCILLATIONS

(75) Inventors: Oliver Sawodny, Nersingen (DE); Jörg Kümpel, Ulm (DE); Cristina Tarin-Sauer, Ulm (DE); Harald Aschemann, Amstetten (DE); Eberhard P. Hofer, Sinabronn (DE); Klaus Schneider, Hergatz (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 457 days.

(21) Appl. No.: 10/399,745

(22) PCT Filed: Oct. 18, 2001

(86) PCT No.: PCT/EP01/12080

§ 371 (c)(1),
(2), (4) Date: Jan. 16, 2004

(87) PCT Pub. No.: WO02/32805

PCT Pub. Date: Apr. 25, 2002

(65) Prior Publication Data

US 2004/0164041 A1 Aug. 26, 2004

(30) Foreign Application Priority Data

Oct. 19, 2000 (DE) ..... 100 51 915
Dec. 22, 2000 (DE) ..... 100 64 182

(51) Int. Cl.
*G07F 7/00* (2006.01)

(52) U.S. Cl. ..... 700/228

(58) Field of Classification Search ..... 700/218; 212/273, 275, 278

See application file for complete search history.

(56) References Cited

U.S. PATENT DOCUMENTS 3,833,189 A * 9/1974 Fowler et al. ..... 244/177
3,838,836 A * 10/1974 Asseo et al. ..... 244/137.4
4,099,696 A * 7/1978 Toome ..... 248/624

(Continued)

FOREIGN PATENT DOCUMENTS

DE 2421613 11/1974

(Continued)

OTHER PUBLICATIONS

Patent Abstacts of Japan Publication No. 2000038286 Published Feb. 8, 2000.

(Continued)

*Primary Examiner*—Patrick Mackey
*Assistant Examiner*—Michael E. Butler
(74) *Attorney, Agent, or Firm*—Dilworth & Barrese LLP

(57) ABSTRACT

The invention concerns a crane or excavator for traversing a load hanging from a load cable, which is movable in three spatial directions. The crane or excavator has a computer-controlled regulation for the damping of load swings, which contains a path planning module, a centripetal force compensation unit and at least one shaft regulator for the rotating gear, one shaft regulator for the luffing gear and one shaft regulator for the lifting gear.

32 Claims, 17 Drawing Sheets

U.S. PATENT DOCUMENTS

| | | | | |
|---|---|---|---|---|
| 4,113,112 | A * | 9/1978 | Ray | 212/71 |
| 4,883,184 | A | 11/1989 | Albus | |
| 5,785,191 | A * | 7/1998 | Feddema et al. | 212/275 |
| 5,823,369 | A | 10/1998 | Kuromoto | |
| 5,908,122 | A | 6/1999 | Robinett et al. | |
| 5,961,563 | A * | 10/1999 | Overton | 701/50 |
| 6,102,221 | A * | 8/2000 | Habisohn | 212/270 |
| 6,425,450 | B1 * | 7/2002 | Lansberry | 180/9.36 |
| 6,496,765 | B1 * | 12/2002 | Robinett et al. | 701/50 |
| 6,601,718 | B2 * | 8/2003 | Sawodny et al. | 212/270 |
| 6,631,300 | B1 * | 10/2003 | Nayfeh et al. | 700/55 |
| 6,962,091 | B2 * | 11/2005 | Lukas | 73/865.9 |

FOREIGN PATENT DOCUMENTS

| | | |
|---|---|---|
| DE | 271686 | 9/1989 |
| DE | 4496685 | 8/1996 |
| DE | 19907989 | 10/1999 |
| NL | 9301243 | 2/1995 |
| WO | WO97/45357 | 12/1997 |

OTHER PUBLICATIONS

Souissi, R., et al.: Modeling and Control of a Rotary Crane for Swing-free Transport of Payloads, Control Applications, 1992, First IEEE Conference, in Dayton Ohio, USA, Sep. 13-16, 1992, New York, NY, USA, IEEE, USA, Sep. 13, 1992, pp. 782-787.

* cited by examiner

PATH PLANNING MODULE 39,41

CRANE OR DIGGER FOR SWINGING A LOAD HANGING ON A SUPPORT CABLE WITH DAMPING OF LOAD OSCILLATIONS

BACKGROUND OF THE INVENTION

The invention concerns a crane or excavator for traversing a load hanging from a support cable that has a computer-controlled regulation system to damp the swinging of the load.

In particular, the invention addresses the load swing damping in the case of cranes or excavators, which permits movement of a load hanging from a cable in at least three degrees of freedom. Such cranes or excavators have a rotating mechanism that can be mounted on a chassis that serves to rotate the crane or excavator. Furthermore, there is a luffing mechanism for raising or lowering a boom. Finally, the crane or excavator includes a lifting mechanism to lift or lower the load hanging from the cable. Such cranes or excavators are in use in the most widely varied designs. For example, mobile port cranes, ships' cranes, offshore cranes, caterpillar-mounted cranes and stripping shovels can be named.

When traversing a load hanging from a cable using such a crane or excavator, swings arise that, on the one hand, can be attributed to the movement of the crane or excavator itself, and also to outside interference such as, for example, wind. Already in the past, efforts have been undertaken to suppress swinging oscillations in the case of load cranes.

Thus, DE 127 80 79 describes an arrangement for the automatic suppression of the swinging of a load hanging by means of a cable from a cable attachment point, which is movable in the horizontal plane, in the case of movement of the cable attachment point in at least one horizontal coordinate, in which the speed of the cable attachment point is affected in the horizontal plane by a regulating circuit dependent upon a value derived from the angle of deflection of the load cable against the end position.

DE 20 22 745 shows an arrangement to suppress the swinging of a load that is attached by means of a cable on the trolley carriage of a crane, whose drive is equipped with a rotational speed device and a distance regulating device with a regulating arrangement that accelerates the trolley carriage, taking into account the period of oscillation during a first part of the distance traveled by the carriage, and which decelerates it during the last part of this distance in such a manner that the movement of the carriage and the oscillation of the load at the destination are both equal to zero.

From DE 321 04 50, there became known a device on lifting equipment for the automatic control of the movement of the load carrier with damping of the swing of the load hanging from it arising during acceleration or braking of the load during an acceleration or braking time interval. The basic idea is based on the simple mathematical pendulum. The trolley and load mass is not included for the calculation of the movement. Coulomb friction and friction proportional to speed of the trolley or rolling car are not taken into account.

In order to be able to transport a load as rapidly as possible from its point of origin to its point of destination, DE 322 83 02 suggests controlling the rotational speed of the drive motor of the trolley by means of a computer, so that the trolley and the load carrier are moved during the steady state run at the same speed and that the damping of swinging is accomplished in the shortest possible time. The computer known from DE 322 83 02 works on a computer program for the solution of the differential equations that apply to the undamped two-mass oscillation system made up of the trolley and the load, where the coulomb and speed-proportional friction of the trolley or rolling crane drive are not taken into account.

In the procedure that became known from DE 37 10 492, the speeds between the destinations along the way are selected in such a manner that, after traveling half the total distance between the starting point and the destination, the swinging deflection is always equal to zero.

The procedure for damping load swinging that became known from DE 39 33 527 includes a normal speed-position regulation.

DE 691 19 913 covers a process to control the setting of a swinging load in which the deviation between the theoretical and actual position of the load is formed in a first regulating circuit. This is derived multiplied by a correction factor and added to the theoretical position of the movable carrier. In a second regulating circuit, the theoretical position of the movable carrier is compared to the actual version, multiplied by a constant and added to the theoretical speed of the movable carrier.

DE 44 02 563 discusses a procedure for the regulating of electrical drives for lifting gear with a load hanging from a cable, which, due to the dynamics of description equations, generates the desired progression of the speed of the crane trolley and feeds it to a speed and current regulation. Furthermore, the computer device can be expanded by a position regulator for the load.

Regulating processes that became known from DE 127 80 79, DE 393 35 27 and DE 691 19 913 require a cable angle sensor for load swing damping. In the expanded design according to DE 44 02 563, this sensor is also required. Since this cable and/or sensor results in substantial costs, it is advantageous if the load swings can be compensated for even without the sensor.

The process of DE 44 02 563 in its basic version also requires at least the crane trolley speed. In DE 20 22 745 as well, multiple sensors are required for load swing damping.

Thus, in DE 20 22 745, at least a rotational speed and position measurement of the crane trolley must be performed.

DE 37 10 492, as well, needs at least the trolley or rolling crane position as supplementary sensors.

Alternatively to this procedure, another application, which became know, for example, from DE 32 10 450 and DE 322 83 02, suggests solving the differential equations on which the system is based and, based on this, determining a control strategy for the system in order to suppress load swings where, in the case of DE 32 10 450, the cable length, and in the case of DE 322 83 02, the cable length and the load mass, are measured. However, in these systems, the friction effects from adhesive friction and friction proportional to velocity, which are not negligible, are not taken into account. Even DE 44 02 563 does not take into account friction and damping times.

SUMMARY OF THE INVENTION

The problem to be solved by this invention is to develop further a crane or excavator for the traversing of a load hanging from a load cable that can move the load at least through three degrees of freedom of motion, in such a manner that the swing movement that actively arises during the movement of the load can be damped so that the load can be carried precisely on a predetermined path.

In accordance with the invention, this problem is solved by a crane or excavator with the characteristics of traversing a load hanging from a load cable with a rotating gear to rotate the crane or excavator, a luffing gear to elevate or depress a boom and a lifting gear to lift or lower the load hanging from the cable with a computer-controlled regulation for damping load swings, which includes a path planning module, a centripetal force compensation device and at least one shaft regulator for the rotating gear, a shaft regulator for the luffing gear and a shaft regulator for the lifting gear. According to this, the crane or excavator is equipped with computer-controlled regulation for damping of the load swings, which includes a trajectory planning module, a centripetal force compensation unit and at least one shaft regulator for the rotating gear, a shaft regulator for the luffing gear and a shaft regulator for the lifting gear.

The pathway control with active damping of the swing motion is based on the principle of portraying the dynamic behavior of the mechanical and hydraulic system of the crane or excavator first in a dynamic model based on differential equations. On the basis of this dynamic model, a control can be developed that, under these idealized suppositions of the dynamic model, suppresses the swinging motion upon movement of the load by the rotating gear, luffing gear and lifting gear and guides the load exactly along the preset path.

A precondition for the control is first the generation of the path in the working space, which is undertaken by the path planning module. The path planning module generates the path that is provided to the controlled unit in the form of time functions for the load position, speed, acceleration, the jerk and the possibly a derivative of the jerk at the control, from the preset desired speed proportional to the deflection of the handling lever in the case of a semi-automatic operation or of desired points in case of fully automatic operation.

The special problem in the case of a crane or excavator of the above-mentioned design lies in the coupling between the rotation and luffing movement, which occurs especially as the centripetal effect is formed in the rotary movement. At this time, the load swings and after rotating can no longer by compensated for. According to this invention, these effects are taken into account in a centripetal force compensation unit provided in the regulation.

Further details and advantages of the invention are shown herein.

If, for example, oscillations or deviations from the desired path should arise in spite of the regulation present, the system of control and path planning module can be supported in the case of extensive deviations from the idealized dynamic model (for example, due to interference such as the effects of wind, etc.) by a supplementary regulator. This leads back to at least one of the feedback signals: pendulum angle in radial and tangential direction, leveling angle, angle of rotation, and horizontal and vertical boom bend, as well as their diversion and load.

It can be advantageous to take as a basis a decentralized control concept with a spatially decoupled dynamic model in which each individual direction of movement is assigned an independent controlled algorithm.

This invention provides an especially efficient and maintenance-friendly control for a crane or excavator of the type named at the beginning.

BRIEF DESCRIPTION OF THE DRAWINGS

Further details and advantages of the invention will be explained on the basis of a sample embodiment represented in the drawing. As a typical representation of a crane or excavator of the sort mentioned at the beginning, the invention is described here on the basis of a mobile port crane.

The following are shown.

DESCRIPTION OF THE PREFERRED EMBODIMENTS

Figure 1:
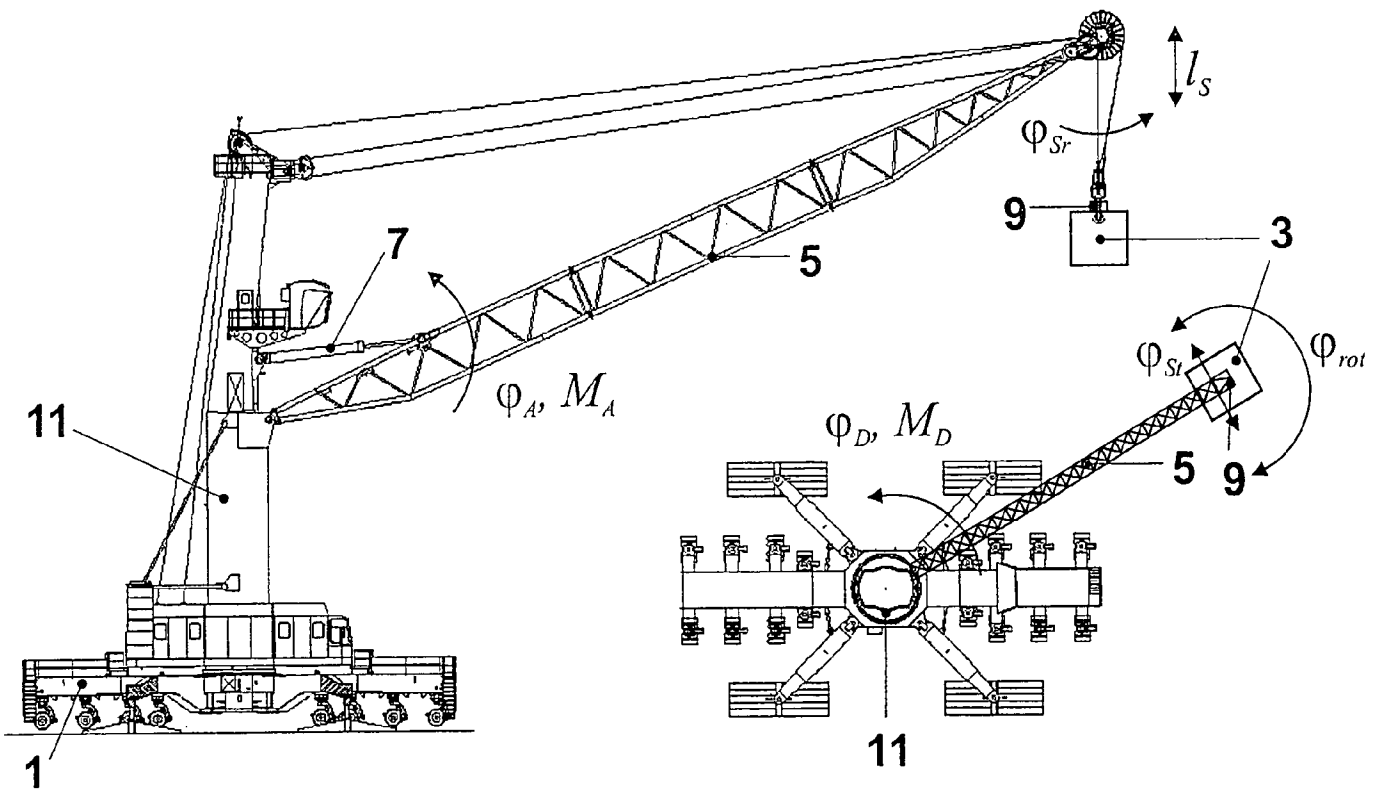
FIG. 1: Principles of the mechanical structure of a mobile port crane

FIG. 1 shows the mechanical structure of a mobile port crane. A mobile port crane is usually mounted on a chassis 1. In order to position the load 3 in the working space, the boom 5 can be inclined with the hydraulic cylinder of the luffing gear 7 around the angle $\phi_A$. With the lifting gear, the cable length $l_s$ can be varied. The tower 11 makes it possible to rotate the boom by the angle $\phi_D$ over on the vertical axis. With the load traversing gear 9, the load can be rotated at the destination point by the angle $\phi_{rot}$.

Figure 2:
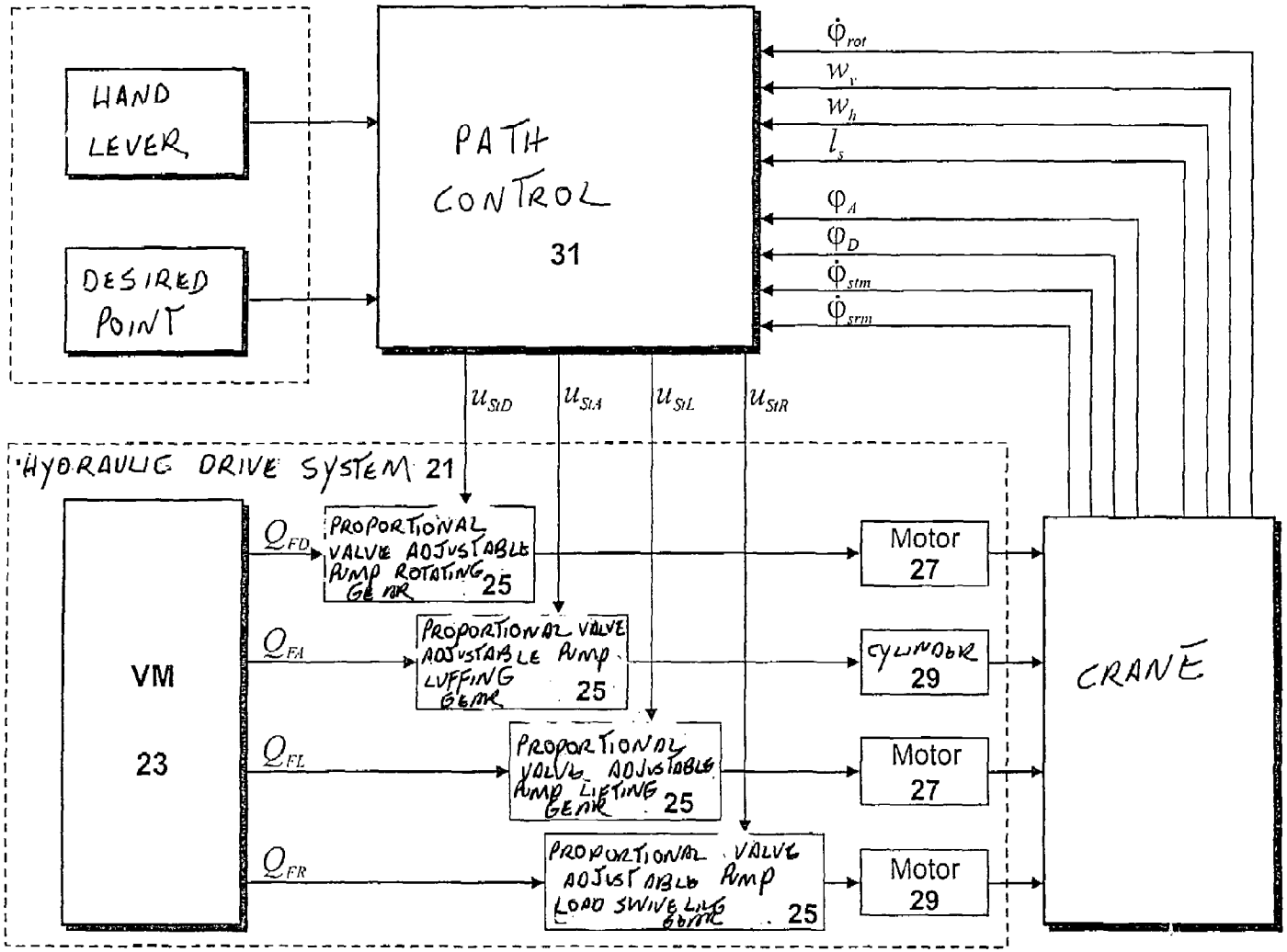
FIG. 2: The working together of hydraulic control and path control

FIG. 2 shows how the hydraulic control and the path control 31 work together. As a rule, the mobile port crane has a hydraulic drive system 21. A combustion engine 23 powers the hydraulic control circuits through a distributor gearbox. Each of the hydraulic control circuits consists of a displacement pump 25, which is controlled by means of a proportional valve in the control circuit, and a motor 27 or cylinder 29 as working machine. Through the proportional valve, therefore, independent of load pressure, a supply stream $Q_{FD}$, $Q_{FA}$, $Q_{FL}$, $Q_{FR}$ is set. The proportional valves are controlled by the signals $U_{SID}$, $U_{SIA}$, $U_{SIL}$, $U_{SIR}$. The hydraulic control is usually equipped with a subordinate supply stream regulation. In this connection, it is essential that the control voltages $U_{SID}$, $U_{SIA}$, $U_{SIL}$, $U_{SIR}$ are converted by the subordinated supply stream regulation into proportional supply streams $Q_{FD}$, $Q_{FA}$, $Q_{FL}$, $Q_{FR}$ in the corresponding hydraulic circuit.

It is now substantial that the time functions for the control voltages of the proportional valves are no longer derived directly from the hand levers, for example, using remp functions, but are calculated in the path control 31 in such a manner that, upon moving the grain, no swing motions of the load arise and the load follows the desired path in the working space.

In fully automatic drive of the mobile crane, swing-free operation also results.

The basis for this is the dynamic model of the crane with the aid of which, based on the sensor data at least of the values $w_v$, $w_h$, $l_s$, $\phi_D$, $\dot{\phi}_{rot}$, $\dot{\phi}_{sfm}$, $\dot{\phi}_{Srm}$ and the guiding inputs $\underline{\dot{q}}_{Ziel}$ or $\underline{q}_{Ziel}$, this problem is solved.

Figure 3:
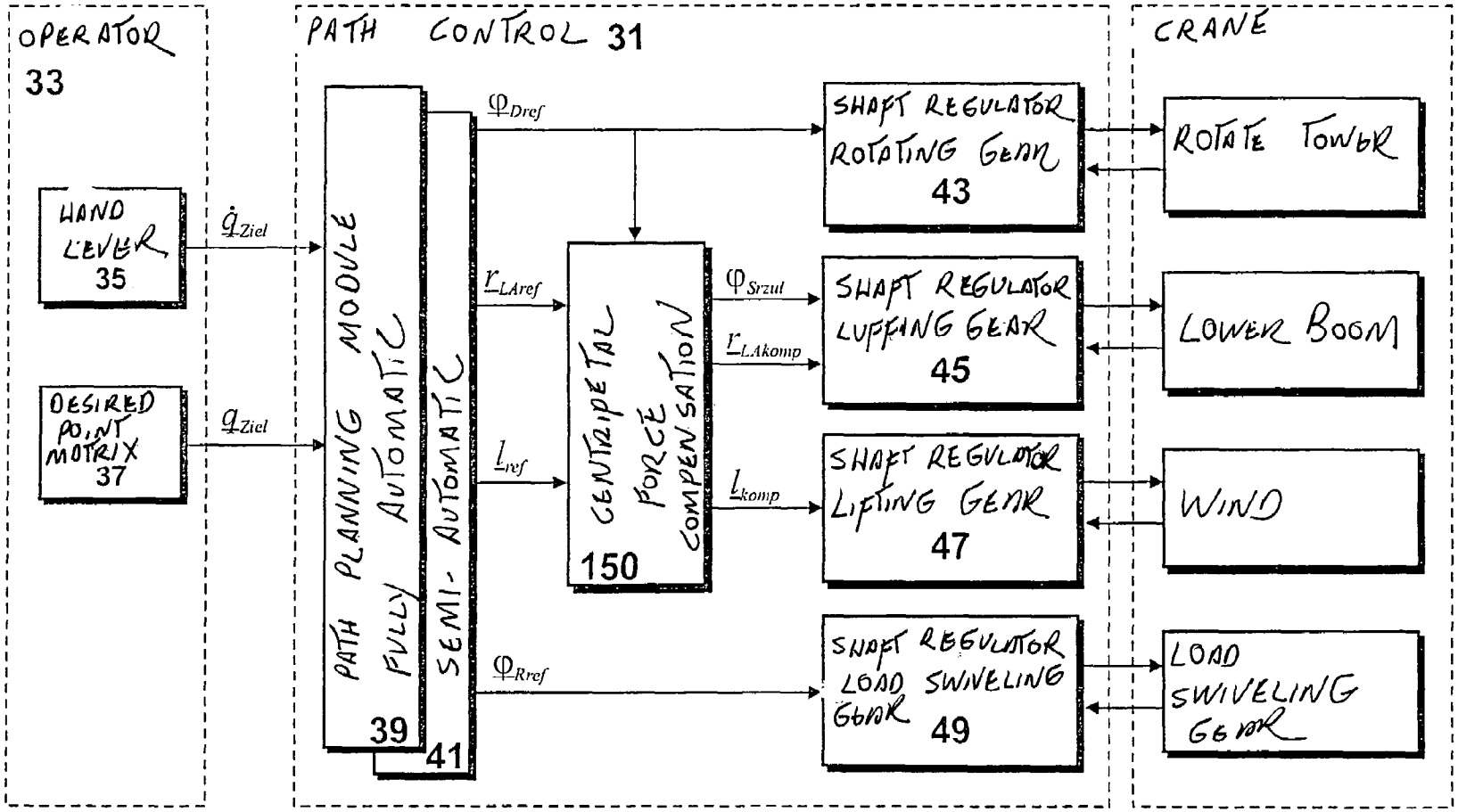
FIG. 3: Overall structure of path control

On the basis of FIG. 3, the overall structure of the path control 31 is explained. The operator 33 enters the desired speed or the desired destination, which has been stored in the computer from a previous run of the crane, either using the hand lever 35 at the operating pulpits or through a desired point matrix 37. The fully automatic or semi-automatic path planning module 39 or 41 calculates from it, taking into account the kinetic limitations (maximum speed, acceleration and jerk) of the crane, the time functions of the desired load position with respect to the rotational, luffing, lifting and load traversing gear as well as their derivatives, which are summarized in the vectors $\underline{\phi}_{Dref}$, $\underline{\phi}_{Aref}$, $\underline{l}_{ref}$, $\underline{\phi}_{Ref}$. The desired position vectors are fed to the shaft regulators 43, 45, 47 and 49, which calculate from them by evaluating at least one of the sensor values $\phi_A$, $\phi_D$, $w_v$, $w_h$, $l_s$, $\dot{\phi}_{rot}$, $\dot{\phi}_{Stm}$, $\dot{\phi}_{Srm}$ (see FIG. 2) the startup function $U_{SID}$, $U_{SIA}$, $U_{SIL}$, $U_{SIR}$ for the proportional values 25 of the hydraulic drive system 21. In the case of rotational movement, the guide instruction for the rotating gear is used in the module for centripetal force compensation 150 to generate a compensatory trajectory for the luffing gear, so that deviations of the load caused by centripetal acceleration are compensated for. In order to assure a constant lifting height in this case, the compensatory movement of the luffing gear is synchronized with the lifting gear movement. At the same time, a permissible cable deflection $\phi_{SrZul}$ is calculated for the luffing gear regulator on the basis of the rotary movement.

In the following, the individual components of the path control are described in detail.

Figure 4:
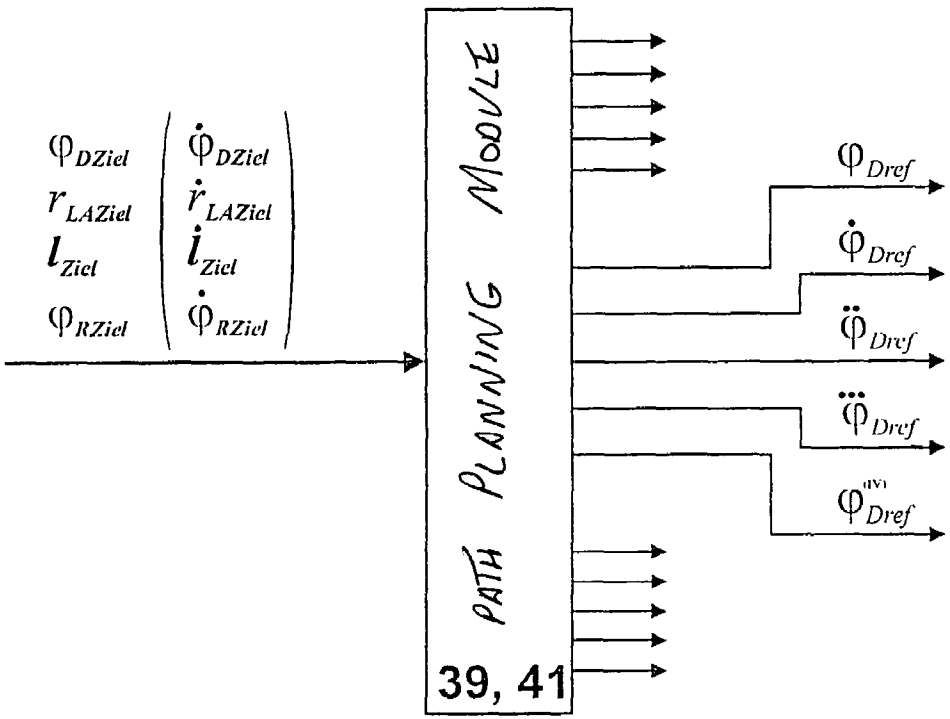
FIG. 4: Structure of the path planning module

FIG. 4 shows the interfaces of the path planning module 39 or 41. In the case of the fully automatic path planning module 39, the destination position vector for the center of the load is given in the form of the coordinates $\underline{q}_{Ziel}=[\phi_{Dziel}, r_{LAZiel}, l_{Ziel}, \phi_{Rziel}]^T$. $\phi_{DZiel}$ is the desired angle of rotation, $r_{LAZiel}$ is the radial destination position for the load and $l_{Ziel}$ is the destination position for the lifting gear or the lifting height. $\phi_{RZiel}$ is the desired value for the load swing gear angle. In the case of the semi-automatic path planning module 41, the starting value is the goal speed vector $\dot{\underline{q}}_{Ziel}=[\phi_{DZiel}, r_{LAZiel}, l_{Ziel}, \phi_{RZiel}]^T$. The components of the goal speed vector are analogous to the goal position vector, the goal speed in the direction of the rotating gear $\dot{\phi}_{DZiel}$ following from the goal speed of the load in the radial direction $\dot{r}_{LAZiel}$, the goal speed for the lifting gear $\dot{l}_{Ziel}$ and the goal rotary speed in the direction of the load swing gear $\dot{\phi}_{RZiel}$. In the path planning module 39 or 41, these preset values are used to calculate the goal function vectors for the load position with respect to the rotational angle coordinates and their derivatives $\phi_{Dref}$, for the load position in the radial direction and its derivatives $\underline{r}_{RZiel}$ and for the lifting height of the load and its derivative $\underline{l}_{ref}$. Each vector covers at most 5 components up to the 4th derivative. In the case of the rotating gear, the individual components are:

- $\phi_{Dref}$: Desired angular position of load center in rotational direction
- $\dot{\phi}_{Dref}$: Desired angular speed of load center in rotational direction
- $\ddot{\phi}_{Dref}$: Desired angular acceleration of load center in rotational direction
- $\dddot{\phi}_{Dref}$: Desired jerk of load center in rotational direction
- $\phi_{Dref}^{(IV)}$: Derivative of desired jerk of load center in rotational direction The vectors for the other directions of movement are built up analogously.

Figure 5:
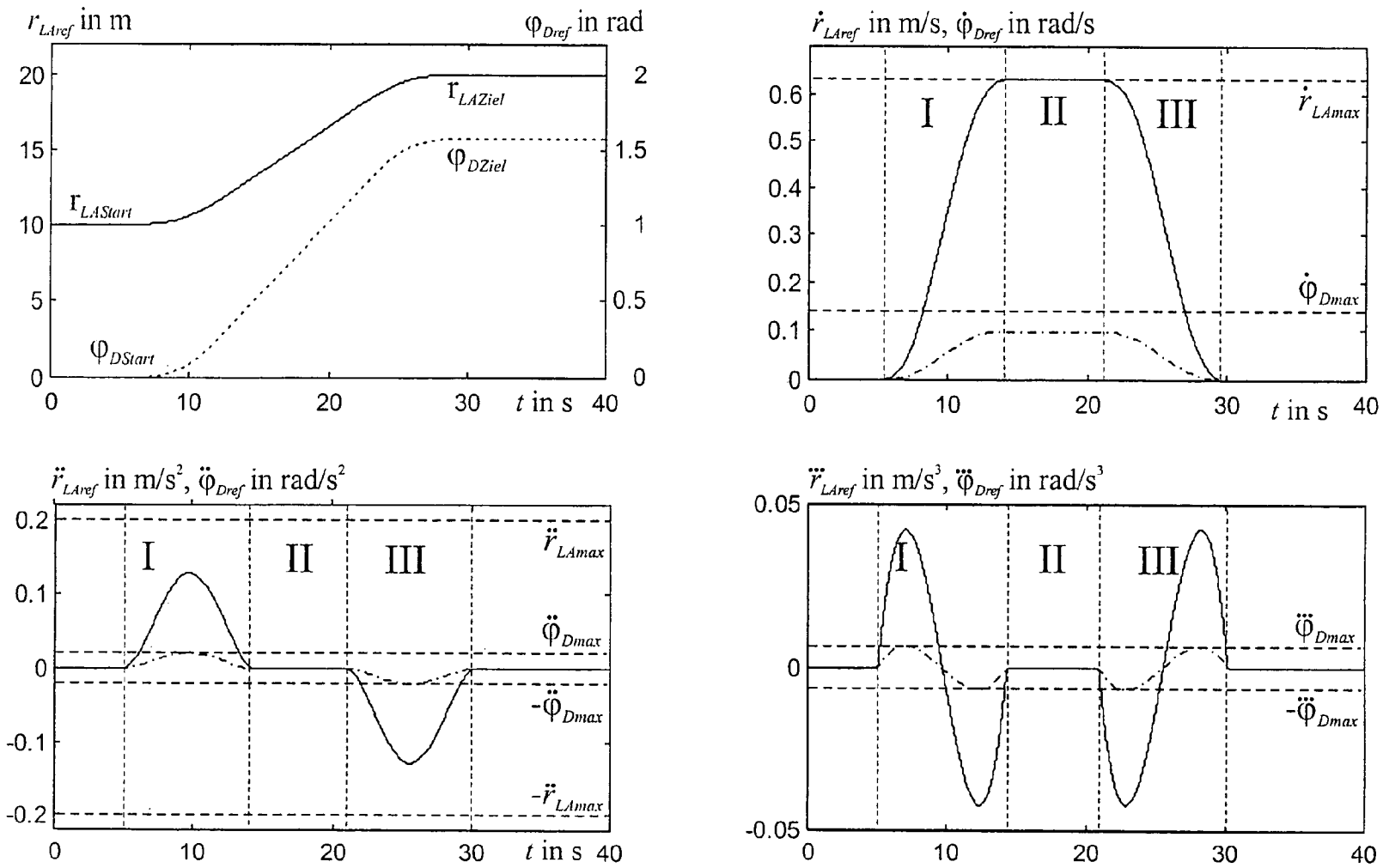
FIG. 5: Examples of path generation with the fully automatic path planning module

FIG. 5 shows as examples the time functions generated for the desired angular position $\phi_{Dref}$, the radial desired position $r_{LAref}$, the desired speeds $\dot{\phi}_{Dref}$, $\dot{r}_{LAref}$, desired accelerations $\ddot{\phi}_{Dref}$, $\ddot{r}_{LAref}$ and desired jerk $\dddot{\phi}_{Dref}$, $\dddot{r}_{LAref}$ from the fully automatic path planning module for a movement with a rotating gear and luffing gear from the starting point $\phi_{Dstart}=0°$, $r_{LAstart}=10$ m to the destination $\phi_{DZiel}=90°$, $r_{LAZiel}=20$ m. In this connection, the time functions are calculated in such a manner that none of the preset kinetic limitations such as the maximum speeds $\dot{\phi}_{Dmax}$, $\dot{r}_{LAmax}$ or the maximum accelerations $\ddot{\phi}_{Dmax}$, $\ddot{r}_{LAmax}$ or the maximum jerk $\dddot{\phi}_{Dmax}$, $\dddot{r}_{LAmax}$ are exceeded. For this purpose, the movement is divided into three phases. An acceleration phase I, a constant speed phase II, which may also be deleted, and a braking phase III. For phases I and III, a polynomial of the third order is assumed for the jerk. As a time function for phase II, a constant speed is assumed. By integrating the jerk function, the lacking time functions for acceleration speed and position are calculated. The coefficients that are still free in the time functions are determined by the marginal conditions and kinetic limits at the start of the movement, at the transition points to the next or previous phases of movement or at the destination, where, with respect to each axis, all kinetic conditions must be examined. In the case of the example from FIG. 5, in Phases I and III, the kinetic limitations of the maximum acceleration $\ddot{\phi}_{Dmax}$ and the jerk $\dddot{\phi}_{Dmax}$ for the rotational axis are effective as limits, in Phase II the maximum speed of the luffing gear rotary axis $\dot{r}_{LAmax}$. The other axes are synchronized to the axis limiting the movement with respect to the travel time. The optimization of time of movement is achieved by determining in an optimization run the minimum total travel time by varying the portion of the acceleration and braking phase in the total movement.

The semi-automatic path planner consists of steepness limiters that are assigned to the individual directions of movement.

Figure 6:
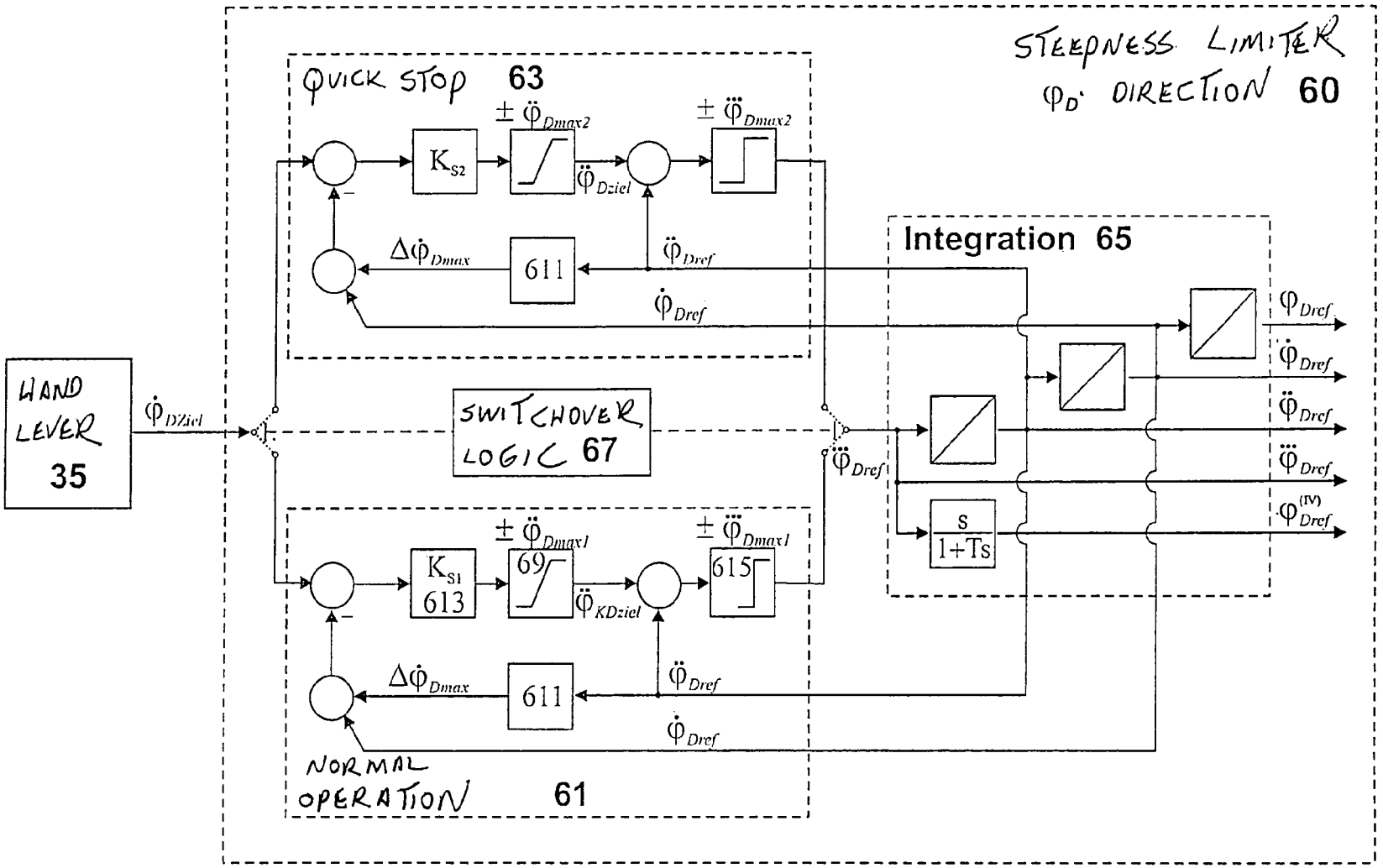
FIG. 6: Structure of the semi-automatic path planning module

FIG. 6 shows the steepness limiter 60 for rotational movement. The goal speed of the load 3 from the hand level of the operating stand $\dot{\phi}_{DZiel}$ is the input signal. This is at first standardized to the value range of the maximum reachable speed $\dot{\phi}_{Dmax}$. The steepness limiter itself consists of two steepness limiting blocks with different parameterization, one for normal operation 61 and one for quick stop 63, between which it is possible to switch back and forth using the switchover logic 67. The time functions at the output are formed by integration 65. The signal flow in the steepness limiter will now be explained on the basis of FIG. 6.

In the steepness limiting block for normal operation 61, first a desired-actual value difference between the goal speed $\dot{\phi}_{DZeil}$ and the current desired speed $\dot{\phi}_{Dref}$ is formed. The difference is amplified with the constant $K_{SI}$ (block 613) and gives as a result the goal acceleration $\ddot{\phi}_{DZiel}$. A limiting member 69 placed in series limits the value to the maximum acceleration $\pm\ddot{\phi}_{Dmax}$. In order to improve dynamic behavior, only the maximum speed change is taken into account in the formation of the desired actual value difference between the goal speed and the current desired speed, as a result of the jerk limitation $\pm\dddot{\phi}_{Dmax}$ in the current desired acceleration $\ddot{\phi}_{Dref}$, $$\Delta\dot{\varphi}_{D\,max} = \frac{\ddot{\varphi}_{Dref}|\ddot{\varphi}_{Dref}|}{2\dddot{\varphi}_{D\,max}} \tag{1}$$

can be reached, which is calculated in block 611. As a result, this value is added to the current desired speed $\dot{\phi}_{Dref}$, resulting in improvement in the dynamics of the total system. The goal acceleration $\ddot{\phi}_{DZiel}$ is then present behind the limiting member 69. With the current desired acceleration $\ddot{\phi}_{Dref}$, a desired-actual value difference is again formed. In the characteristic block 615, this is used to form the desired jerk $\dddot{\varphi}_{Dref}$ in accordance with $$\dddot{\varphi}_{Dref} = \begin{cases} +\dddot{\varphi}_{D\,max} & \text{für } \ddot{\varphi}_{DZiel} - \ddot{\varphi}_{Dref} > 0 \\ 0 & \text{für } \ddot{\varphi}_{DZiel} - \ddot{\varphi}_{Dref} = 0 \\ -\dddot{\varphi}_{D\,max} & \text{für } \ddot{\varphi}_{DZiel} - \ddot{\varphi}_{Dref} < 0 \end{cases} \tag{2}$$

Filtering is used to smooth the block-shaped progression of this function. From the desired jerk function $\dddot{\varphi}e_{Dref}$, now calculated, integration in block 65 is used to determine the desired acceleration $\ddot{\phi}_{Dref}$, the desired speed $\dot{\phi}_{Dref}$ and the desired position $\phi_{Dref}$. The derivative of the desired jerk is determined by differentiation in block 65 and simultaneous filtering from the desired jerk $\dddot{\phi}_{Dref}$.

In normal operation, the kinetic limitations $\ddot{\phi}_{Dmax}$ and $\dddot{\phi}_{Dmax}$ as well as the proportional amplification $K_{SI}$ is set in such a way that a subjectively pleasant and gentle behavior results for the crane operator. This means that the maximum jerk and acceleration are set somewhat lower than the mechanical system would permit. However, especially in the case of high travel speeds, the overrun of the system is high. That is, if the operator sets the goal speed to 0 from full speed, then the load takes several seconds before it comes to a stop. Since such settings are especially made in emergency situations with collision threatening, therefore, a second operating mode is introduced that provides for a quick stop of the crane. For this purpose, a second steepness limiting block 63 is placed parallel with the steepness limiting block for normal operation 61, which is structurally identical. However, the parameters that determine the overrun are increased to the mechanical load limits of the crane. Therefore, this block is parameterized with the maximum quick stop acceleration $\ddot{\phi}_{Dmax2}$ and the maximum quick stop jerk $\dddot{\phi}_{Dmax2}$ as well as the quick stop proportional amplification $K_{S2}$. It is possible to switch back and forth between the two steepness limiters by means of a switchover logic 67 that identifies the emergency stop from the hand lever signal. The output of the quick stop steepness limiter 63 is, as in the steepness limiter for normal operation, the desired jerk $\dddot{\phi}_{Dref}$. The calculation of the other time functions is done in the same manner as in normal operation in block 65.

In this connection, the time functions for the desired position of the load in the rotational direction and its derivative, taking into account the kinetic limitations, are available at the output of the semi-automatic path planner as well as on the fully automatic path planner.

Figure 6A:
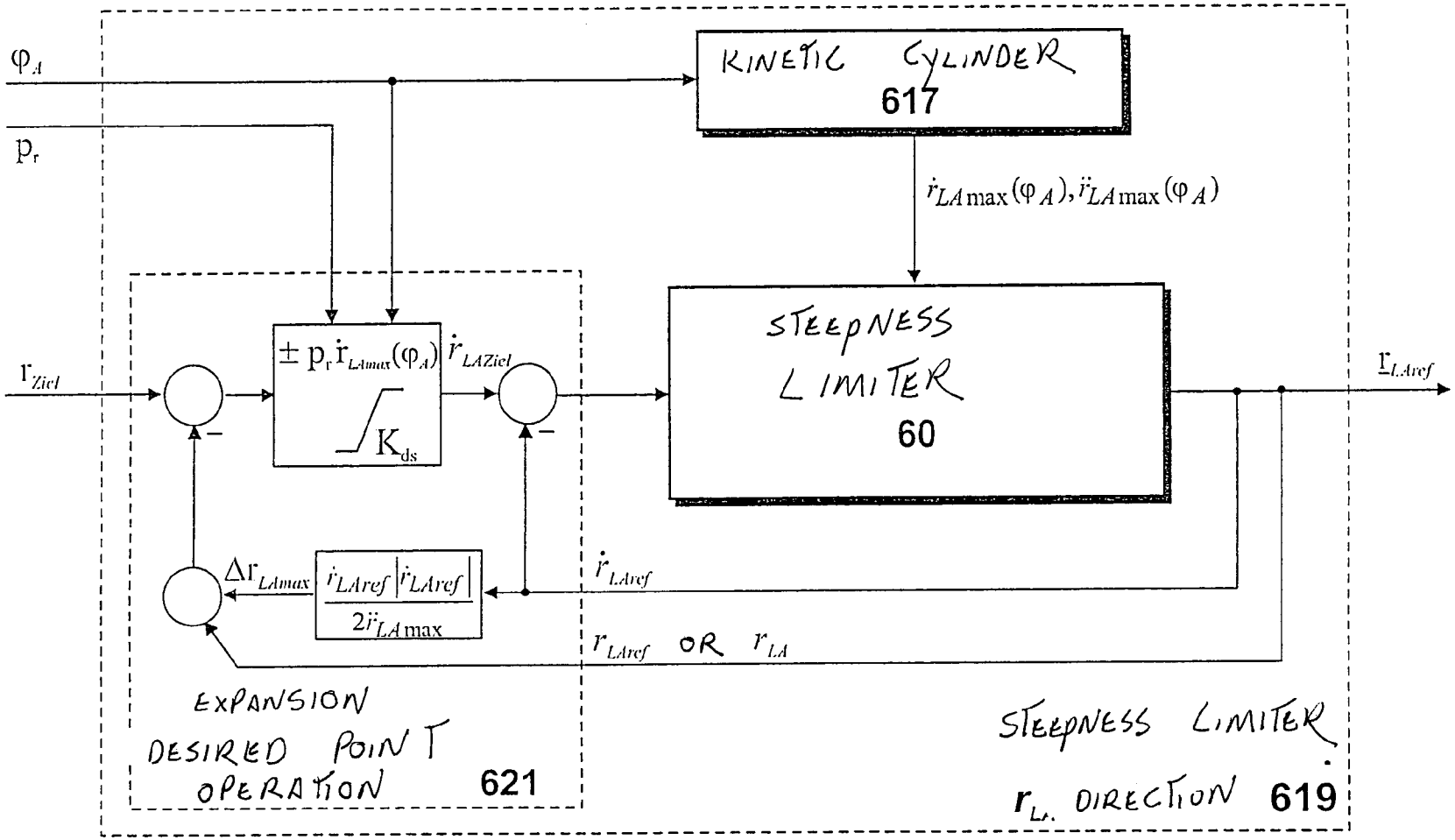
Figure 6A:
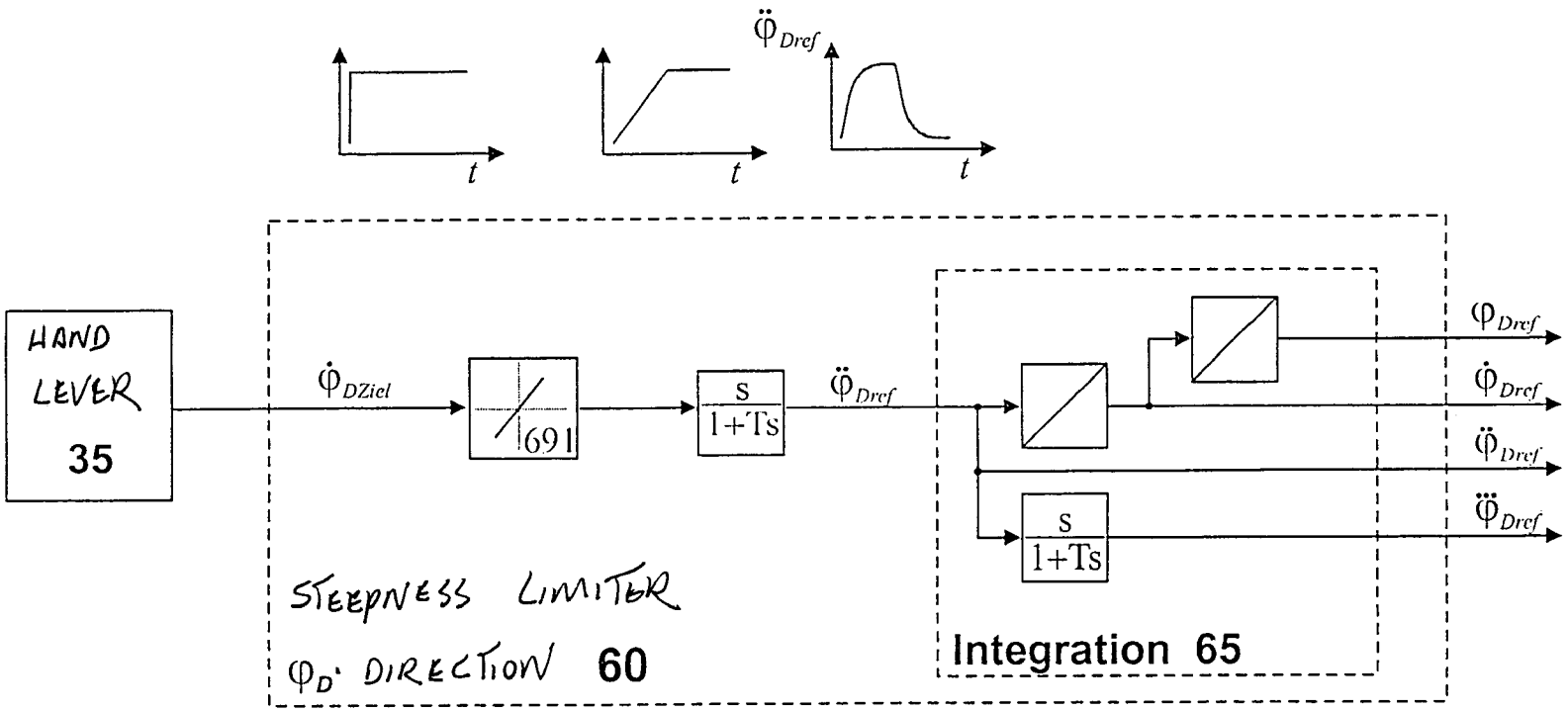

As an alternative to this steepness limiter presented, a structure can also be used in which the desired speed signal, limited to the maximum speed in the steepness of the increasing and decreasing flank in the block (691), is limited to a defined value that corresponds to the maximum acceleration (FIG. 6*aa*). This signal is subsequently differentiated and filtered. The result is the desired acceleration $\ddot{\phi}_{Dref}$. For the calculation of the desired speed $\dot{\phi}_{Dref}$ and the desired position $\phi_{Dref}$, this signal is integrated for the calculation of $\ddot{\phi}_{Dref}$, it is actually differentiated again.

Figure 6B:
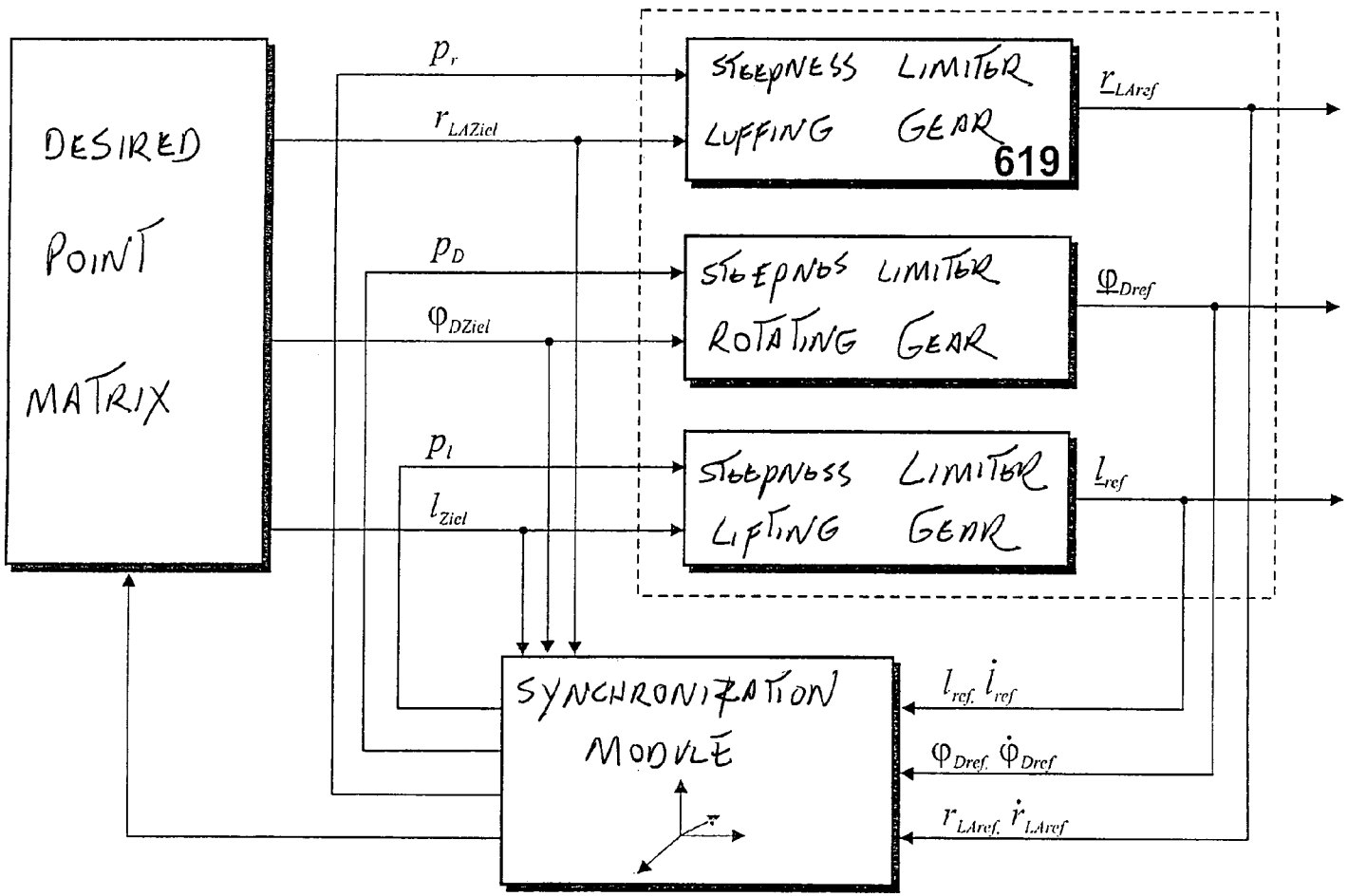

The steepness limiter in the semi-automatic path planner can also be used for the fully automatic path planner (FIG. 6*a*). This is advantageous because, especially in a movement in a radial direction, the kinetic limitations are dependent upon the boom angle. Therefore, the kinetic limitations $\dot{r}_{LAmax}$ and $\ddot{r}_{LAmax}$ are calculated in a block dependent upon the boom position using the kinetics of the luffing gear (see also FIG. 11) and the limitations carried forward (block 617). As a result, the travel time is shortened. In addition, an expansion can be introduced for fully automatic operation (block 621). The new input value is the goal position, instead of the goal speed. This has the advantage that, in the expansion 621 in the case of the desired-actual comparison, between the goal position $r_{Ziel}$ and the desired position $r_{LAref}$, alternatively also the desired-actual comparison between goal position $r_{Ziel}$ and the measured actual position $r_{LA}$ can be calculated and used as an input value for the steepness limiter 60. As a result, position errors can be eliminated in this additional regulating loop. Since the movements between the individual directions of movement are, however, no longer synchronized, a synchronization module (623) is introduced (FIG. 6*b*), which adjusts the maximum speeds using proportionally factors $p_D$, $p_r$, $p_L$, so that a synchronous linear movement results.

For this purpose, a place vector is calculated from the starting and destination points, which indicates the direction for the desired movement. The load will then move precisely always on this pathway, in the direction of the place vector, if the current speed direction vector always points in the same direction as the plane vector. The current speed vector is, however, affected by the proportionality factors $p_D$. $p_r$, $p_L$; that is, by purposely changing these proportionality factors, the synchronization problem is solved.

The time functions are fed to the shaft regulators. First, the structure of the shaft regulator for the rotating gear should be explained on the basis of FIG. 7.

The output functions of the path planning module in the form of the desired position of the load in the rotational direction, as well as their derivatives (speed, acceleration, jerk and derivative of the jerks), are input on the control block 71. In the control block, these functions are amplified in such a manner that they provide as a result that the load travels precisely along the path with respect to the rotational angle without swinging under the idealized conditions of the dynamic model.

The basis for determining the control amplification is the dynamic model, which will be derived in the following sections for the rotational movement. In this respect, under these idealized conditions, the swinging of the load is suppressed and the load follows the path generated.

However, since interference such as wind effects on the crane load can occur and the idealized model can provide the actual dynamic conditions present only in partial aspects, optionally the control can be supplemented by a condition regulator block 73. In this block, at least one of the following measured values is amplified and fed back to the setting input: rotational angle $\phi_D$, rotational angular speed $\dot{\phi}_D$, bending of the boom in the horizontal direction (rotational direction) $w_h$, derivative of the bending $\dot{w}_h$, cable angle $\phi_{St}$ or cable angular speed $\dot{\phi}_{St}$. The derivatives of the measured values $\phi_D$ and $w_h$ are determined numerically in the microprocessor control. The cable angle can, for example, be sensed using a gyroscopic sensor, an acceleration sensor on the load hook, through a hall measuring frame, an image processing system or the expansion measuring stripe on the boom. Since none of these measurement methods determines the cable angle directly, the measurement signal is prepared in an interference observation module (block 77). This is explained as an example following the example of the measurement signal preparation for the measurement signal of a gyroscope on the load hook. In the interference observer, the relevant proportion of the dynamic model is stored for this purpose and through a comparison of the measured values with the calculated value in the idealized model, estimated values for the measured value and its interference factors is formed, so that a measured value compensated for interference can be constructed according to it.

Since the hydraulic drive systems are marked by non-linear dynamic properties (hysteresis, dead spots), the value now calculated from the control and optional condition regulator output for the setting input $u_{Dref}$ in the hydraulic compensation graph 75 is changed in such a manner that the resulting linear behavior of the overall system can be assumed. The output of block 75 (hydraulic compensation) is the corrected setting value $u_{StD}$. This value is then fed to the proportional valve of the hydraulic circulation for the rotating gear.

The derivative of the dynamic model for the rotational axis should now serve as a detailed explanation of the procedure; it is the basis for the calculation of the control amplifications of the condition regulator and the interference observer.

Figure 8:
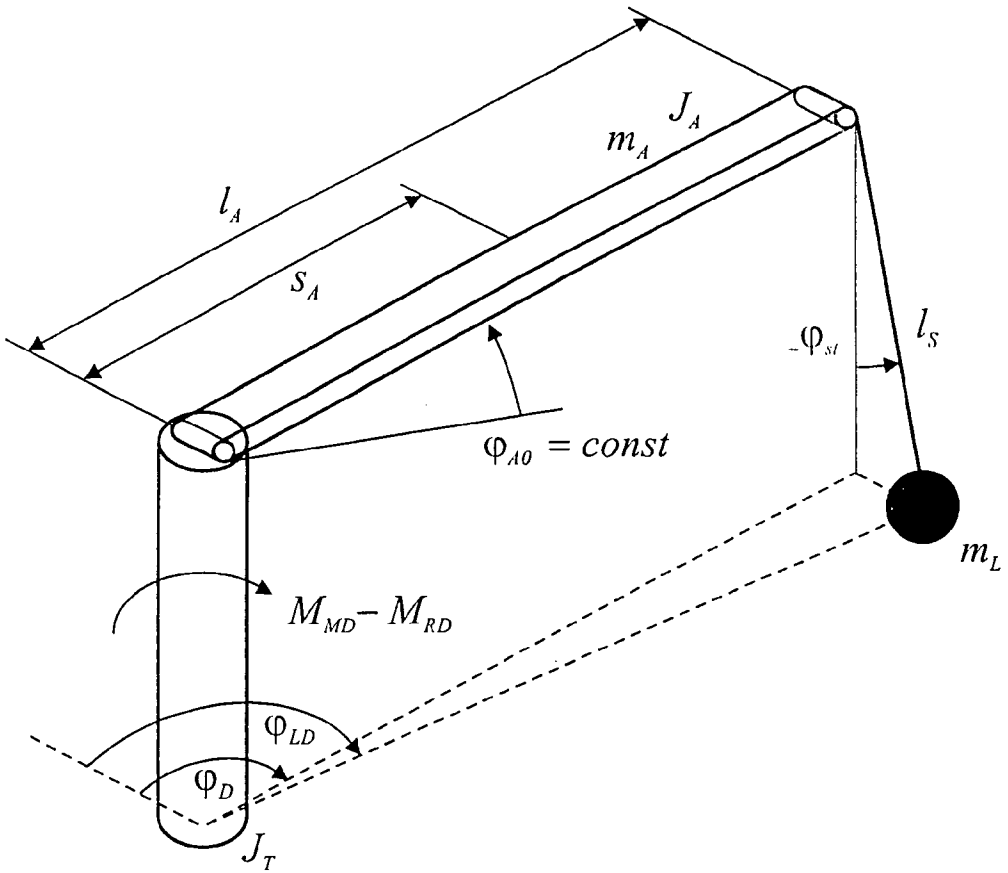
FIG. 8: Mechanical structure of the rotating gear and definition of model variables

For this, FIG. 8 provides explanations of the definition of the model variables. What is essential is the relationship shown there between the rotational position $\phi_D$ of the crane tower and the load position $\phi_{LD}$ in the direction of rotation. In the following, the boom will be considered to be stiff and therefore the bending $w_h$ of the boom is ignored. It is however not difficult to integrate this bending into the model. As a result, however, the system order increases and the derivation becomes more complex. The load rotational angle position is then corrected to $$\varphi_{LD} = \varphi_D + \frac{l_S}{l_A \cos\varphi_A} \sin\varphi_{St} \tag{3}$$

$l_S$ is here the resulting cable length from the boom head to the center of the load. $\phi_A$ is the current angle of elevation of the luffing gear, $l_A$ is the length of the boom, $\phi_{St}$ is the current cable angle in the tangential direction.

The dynamic system for the movement of the load in the rotational direction can be described by the following differential equations $$\begin{aligned} &[J_T+(J_{AZ}+m_A s_A^2+m_L l_A^2)\cos^2\phi_A]\ddot{\phi}_D+m_L l_A l_s \cos\phi_A \\ &\quad \ddot{\phi}_{st}+b_D\dot{\phi}_D=M_{MD}-M_{RD} m_L l_A l_s \cos\phi_A \ddot{\phi}_D+m_L l_s^2 \\ &\quad \ddot{\phi}_{st}+m_L g l_s \phi_{st}=0 \end{aligned} \tag{4}$$

Definitions:

| | |
|---|---|
| $m_L$ | load mass |
| $l_S$ | cable length |
| $m_A$ | boom mass |
| $J_{AZ}$ | moment of inertia of the boom with respect to the center of gravity when rotating along vertical axis |
| $l_A$ | length of boom |
| $s_A$ | distance of center of gravity of the boom |
| $J_T$ | moment of inertia of the tower mass |
| $b_D$ | viscous damping in drive |
| $M_{MD}$ | moment of drive |
| $M_{RD}$ | moment of friction |

The first equation of (4) describes essentially the movement equation for the crane tower with boom, where the reaction through the swinging of the load is taken into account. The second equation of (4) is the movement equation, which describes the load swing through the angle $\phi_{St}$, where the excitation of the load swing is caused by the rotation of the tower through the angular acceleration of the tower or an outside factor, expressed through the beginning conditions for these differential equations.

The hydraulic drive is described by the following equations.

$$M_{MD} = i_D \frac{V}{2\pi} \Delta p_D \tag{5}$$

$$\Delta p_D = \frac{1}{V\beta}\left(Q_{FD} - i_D \frac{V}{2\pi}\dot{\varphi}_D\right)$$

$$Q_{FD} = K_{PD} u_{StD}$$

$I_D$ is the transmission ratio between motor RPM and rotational speed of the tower, V is the absorption volume of the hydraulic motors, $\Delta p_D$ is the pressure drop across the hydraulic drive motor, $\beta$ is the compressibility of all, $Q_{FD}$ is the supply stream in hydraulic circuit for rotation and $K_{PD}$ is the proporationality constant that indicates the relationship between the supply stream and the control voltage of the proportional valve. Dynamic effects of the underlying support stream regulation are ignored.

The equations can now be transformed into conditional space representation (see also O. Fölinger: Regulating Technology, 7th Edition, Hüthig Publishing House, Heidelberg, 1992). The following condition space representation results.

$$\text{Condition space representation: } \underline{\dot{x}}_D = \underline{A}_D \underline{x}_D + \underline{B}_D \underline{u}_D \tag{6}$$

$$\underline{y}_D + \underline{C}_D \underline{x}_D$$

with:

Condition vector:

$$x_D = \begin{bmatrix} \varphi_D \\ \dot{\varphi}_D \\ \varphi_{St} \\ \dot{\varphi}_{St} \end{bmatrix} \tag{7}$$

$$\text{Control value: } u_D = u_{SiD} \tag{8}$$

$$\text{Starting value: } y_D = \phi_{LD} \tag{9}$$

$$\text{System matrix: } \underline{A}_D = \begin{bmatrix} 0 & 1 & 0 & 0 \\ 0 & -\frac{ce}{ae-b^2} & \frac{fb}{ae-b^2} & 0 \\ 0 & 0 & 0 & 1 \\ 0 & \frac{cb}{ae-b^2} & -\frac{af}{ae-b^2} & 0 \end{bmatrix} \tag{10}$$

$$a = J_T + (J_{AZ} + m_A S_A^2 + m_L l_A^2)\cos(\varphi_A)^2$$

$$b = m_L l_A l_S \cos(\varphi_A)$$

$$c = b_D + \frac{1}{4}\frac{i_D^2 V}{\pi^2 \beta}$$

$$d = \frac{1}{2}\frac{i_D\ K_{PD}}{\pi\beta}$$

$$e = m_L l_S^2$$

$$f = m_L g l_S$$

-continued $$\text{Control vector:}\quad \underline{B}_D = \begin{bmatrix} 0 \\ \frac{de}{ae-b^2} \\ 0 \\ -\frac{bd}{ae-b^2} \end{bmatrix} \tag{11}$$

$$\text{Starting vector:}\quad \underline{C}_D = \begin{bmatrix} 1 & 0 & \frac{l_S}{\cos(\varphi_A)l_A} & 0 \end{bmatrix} \tag{12}$$

The dynamic model of the rotating gear is understood as a system whose parameters can be changed with respect to the cable length $l_S$, the angle of elevation $\phi_A$, the load mass $m_L$.

Equations (6) through (12) are the basis for the draft of the control 71, the condition regulator 73 and the interference observer 77, now to be described.

Input values for the control block 71 are the desired angle position $\phi_{Dref}$, the desired angular speed $\dot{\phi}_{Dref}$, the desired angular acceleration $\ddot{\phi}_{Dref}$, the desired jerk $\dddot{\phi}_{Dref}$ and, if appropriate, the derivative of the desired jerk $\phi^{(4)}_{Dref}$. The guide value vector $\underline{w}_D$ is therefore $$\underline{w}_D = \begin{bmatrix} \varphi_{Dref} \\ \dot{\varphi}_{Dref} \\ \ddot{\varphi}_{Dref} \\ \dddot{\varphi}_{Dref} \\ \varphi^{(IV)}_{Dref} \end{bmatrix} \tag{13}$$

In the control block 71, the components of $\underline{w}_D$ are input weighted with the control amplifications $K_{VD0}$ through $K_{VD4}$ and their sum into the setting input. If the shaft regulator for the axis of rotation does not include a condition regulator block 73, then the value $U_{Dvorst}$ from the control block is equal to the reference start voltage $U_{Dref}$ which, after compensation for hydraulic non-linearity, is indicated as the start voltage $U_{StD}$ on the proportional valve. The condition space representation (6) is thereby expanded to $$\dot{\underline{x}} = \underline{A}_D\underline{x}_D + \underline{B}_D\underline{S}_D\underline{w}_D \tag{14}$$

$$\underline{y}_D = \underline{C}_D\underline{x}_D$$

with the control matrix $$\underline{S}_D = [K_{VD0}K_{VD1}K_{VD2}K_{VD3}K_{VD4}] \tag{15}$$

If the matrix equation (14) is used, then it can be written as an algebraic equation for the control block, where $U_{Dvorst}$ is the uncorrected desired starting voltage for the proportional valve based on the idealized model.

$$u_{Dvorst} = K_{VD0}\phi_{Dref} + K_{VD1}\dot{\phi}_{Dref} + K_{VD2}\ddot{\phi}_{Dref} + K_{VD3}\dddot{\phi}_{Dref} + K_{VD4}\phi^{(IV)}_{Dref} \tag{16}$$

$K_{VD0}$ through $K_{VD4}$ are the control amplifications that are calculated depending upon the current elevation angle $\phi_A$, the cable length $l_S$ and the load mass $m_L$ so that the load follows the desired trajectory on a precise path without swinging.

The control amplifications $K_{VD0}$ through $K_{VD4}$ are calculated as follows. With respect to the regulating value angle position of the load $\phi_{LD}$, the carryover function without the control block is indicated as follows from the condition equations (6) through (12) according to the relationship $$G(s) = \frac{\varphi_{LD}(s)}{u_{Dvorst}(s)} = \underline{C}_D(sI - \underline{A}_D)^{-1}\underline{B}_D \tag{17}$$

Now the control block must be taken into account in the carryover function. As a result, from (17):

$$G_{VD}(s) = \frac{\varphi_{LD}}{\varphi_{Dref}} = G(s)\cdot(K_{VD0} + K_{VD1}s + K_{VD2}s^2 + K_{VD3}s^3 + K_{VD4}s^4) \tag{18}$$

This expression has the following structure after being multiplied out:

$$\frac{\varphi_{LD}}{\varphi_{Dref}} = \frac{\ldots b_2(K_{VDi})\cdot s^2 + b_1(K_{VDi})\cdot s + b_0(K_{VDi})}{\ldots\ a_2\cdot s^2 + a_1\cdot s + a_0} \tag{20}$$

To calculate the amplifications $K_{VD1}$ ($K_{VD0}$ through $K_{VD4}$), only the coefficients $b_4$ through $b_0$ and $a_4$ through $a_0$ are of interest. An ideal system behavior with respect to position, speed, acceleration, jerk and, where appropriate, the derivative of the jerk, is provided precisely if the carryover function of the entire system of control and carryover function of the rotating system needs the following conditions according to equation 19 or 20 in their coefficients $b_i$ and $a_i$:

$$\frac{b_0}{a_0} = 1 \tag{21}$$

$$\frac{b_1}{a_1} = 1$$

$$\frac{b_2}{a_2} = 1$$

$$\frac{b_3}{a_3} = 1$$

$$\frac{b_4}{a_4} = 1$$

This linear system of equations can be solved in an analytical manner according to the control amplifications $K_{VD0}$ through $K_{VD4}$ which are sought.

For example, let this be shown for the case of the model according to equations 6 through 12. The use of equation 20 according to the conditions of equation 21 provides for the control amplifications $K_{VD0}$ through $K_{VD4}$:

$$K_{VD0} = 0 \tag{23}$$

$$K_{VD1} = \frac{c}{d}$$

$$K_{VD2} = \frac{-a}{d}$$

$$K_{VD3} = \frac{-l_s cb}{\cos(\varphi_A)l_A df}$$

$$K_{VD4} = \frac{l_S\ ab - \cos(\varphi_A)l_A b^2}{d\ \cos(\varphi_A)l_A f}$$

This has, as an advantage, that these control amplifications are now present, dependent upon the model parameters. In the case of the model according to equations (6) through (12), the model parameters are $K_{PD}$, $i_D$, V, $\phi_A$, $\beta$, $J_T$, $J_{AZ}$, $m_A$, $s_A$, $m_L$, $I_A$, $I_S$, $b_D$.

The change of model parameters such as of the angle of elevation $\phi_A$, the load mass $m_l$ and the cable length $I_S$ can immediately be taken into account in the change of the control amplifications. Thus, these can be carried out in each case depending upon the measured values of $\phi_A$, $m_L$ and $I_S$. That is, if the lifting gear changes the cable length, then automatically the control amplifications of the rotation gear are automatically changed so that, as a result, the swing damping behavior of the control remains as the load is transported.

Furthermore, in the case of transfer to another crane type with other technical data, the control amplifications can be adjusted very rapidly.

The parameters $K_{PD}$, $i_D$, V, $\beta$, $J_T$, $J_{AZ}$, $m_A$, $s_A$, and $I_A$ are available from the technical data sheet. In principle, the parameters $i_S$, $\phi_A$, and $m_L$ are determined from sensor data as changeable system parameters. The parameters $J_T$, $J_{AZ}$ are known from FEM research. The damping parameter $b_D$ is determined from frequency response measurements.

With the control block, it is now possible to start the rotational axis of the crane in such a manner that, under the idealized conditions of the dynamic model according to equations (6) through (12), no swinging of the load occurs upon moving the load and the load follows precisely the path generated by the path planning module. The quality of function of the control depends upon which derivation the desired functions are brought up to. Optimized system behavior is obtained by bringing them up to the degree of the system order; in the case according to equation 6 through 12, this is degree 4. A gradual improvement is obtained with each further desired function brought in, beginning at degree 1, as compared to the case in which the system is designed only for a stationary position. This applies in principle and is to be carried over analogously to the luffing gear.

The dynamic model is, however, only an abstracted reflection of the actual dynamic conditions. In addition, interference (such as a high wind or the like) can affect it from outside.

For this reason, the control block 71 is supported by a condition regulator 73. At least one of the measured values $\phi_{St}$, $\dot{\phi}_{St}$, $\phi_D$, $\dot{\phi}_D$ is weighted with a regulator amplification and fed back into the condition regulator. (In case of modeling of the boom bending, one of the measured values could $w_h$ or $\dot{w}_h$, could be fed back in order to compensate for the boom oscillations.) There, the difference between the beginning value of the control block 71 and the beginning value of the condition regulator block 73 is formed. If the condition regulator block is present, it must be taken into account in the calculation of the control amplifications.

As a result of the feedback, equation (14) changes to $$\dot{\underline{x}}_D=(\underline{A}_D-\underline{B}_D\underline{K}_D)\underline{x}_D+\underline{B}_D\underline{S}_D\underline{w}_D \tag{24}$$

$$\underline{y}_D=\underline{C}_D\underline{x}_D$$

$\underline{K}_D$ is the matrix of the regulator amplifications of the condition regulator with the entries $k_{1D}$, $k_{2D}$, $k_{3D}$, $k_{4D}$. The description transfer function changes correspondingly, the basis for the calculation of the control amplifications is, according to (17)

$$G_{DR}(s)=\frac{\varphi_{LD}(s)}{u_{Dworst}(s)}=\underline{C}_D(sI-A_D+B_DK_D)^{-1}B_D \tag{25}$$

For the calculation of the control amplifications $K_{Vdi}$ ($K_{VD0}$ through $K_{VD4}$) again becomes first (25) and analogous to (18) in order to expand the switching up of the guide values.

$$G_{VDR}(s)=\frac{\varphi_{LD}}{\varphi_{Dref}}=G_{DR}(s)\cdot(K_{VD0}+K_{VD1}s+K_{VD2}s^2+K_{VD3}s^3+K_{VD4}s^4) \tag{27}$$

In the case of the feedback, however, the transfer function also depends on the regulating amplifications $k_{1D}$, $k_{2D}$, $k_{3D}$, $k_{4D}$. Therefore, the following structure arises $$\frac{\varphi_{LD}}{\varphi_{Dref}}=\frac{\ldots\ b_2(K_{VDi},k_{Di})\cdot s^2+b_1(K_{VDi},k_{Di})\cdot s+b_0(K_{VDi},k_{Di})}{\ldots\ a_2\cdot s^2+a_1\cdot s+a_0} \tag{26}$$

This expression has the same structure with respect to $K_{Vdi}$ ($K_{VD0}$ through $K_{VD4}$) as equation (20). An ideal system behavior with respect to position, speed, acceleration, jerk and possibly the derivative of the jerk is obtained precisely if the transfer function of the entire system of control and transfer function of the rotational axis of the crane, according to equation 26, in its coefficients $b_i$ and $a_i$ satisfies the condition (21).

This again leads to a linear system of equations, which can be solved in analytical form for the control amplifications $K_{VD0}$ through $K_{VD4}$ which are sought. However, the coefficients $b_i$ and $a_i$ in addition to the control amplifications $K_{VD0}$ through $K_{VD4}$ which are sought are now dependent upon the known regulator amplifications $k_{1D}$, $k_{2D}$, $k_{3D}$, $k_{4D}$ of the condition regulator, whose derivation is explained in the following part of the description of the invention.

For the control amplifications $K_{VD0}$ through $K_{VD4}$ of the control block 71, we obtain, taking into account the condition regulator block 73

$$\begin{aligned}
K_{VD0}&=k_1\\
K_{VD1}&=\frac{c+dk_2}{d}\\
K_{VD2}&=\frac{-\cos(\varphi_A)l_A fa+\cos(\varphi_A)l_A bdk_2-dl_S bk_1}{\cos(\varphi_A)l_A df}\cdot(-1)\\
K_{VD3}&=-\frac{(\cos(\varphi_A)l_A dk_4-l_S c-l_S dk_2)b}{\cos(\varphi_A)l_A df}\\
K_{VD4}&=\frac{((e\cos(\varphi_A)^2l_A^2dk_2-e\cos(\varphi_A)l_A dl_A k_1+l_A\cos(\varphi_A)l_A fa-\cos(\varphi_A)^2l_A^2bf+\beta bdk_2-l_A b\cos(\varphi_A)l_A dk_4)b)}{(d\cos(\varphi_A)^2l_A^2f^2)}
\end{aligned} \tag{28}$$

Therefore, with equation (28), analogous to equation (23), control amplifications are known that guarantee an exact travel of the load in the rotational direction without swinging based on the idealized model. Now the condition regulator amplifications $k_{1D}$, $k_{2D}$, $k_{3D}$, $k_{4D}$ are to be determined. This will be explained below.

The regulator feedback 73 is designed as a complete condition regulator. A complete condition regulator is characterized by the fact that each condition value, that is, each component of the condition vector $\underline{x}_D$ is weighted with a regulation amplification $k_{iD}$ and fed back to the setting input of the segment. The regulation amplifications $k_{iD}$ are summarized to the regulating vector $\underline{K}_D$.

According to "Unbehauen, Regulation Technology 2, the work cited," the dynamic behavior of the system is determined by the position of the individual values of the system matrix $\underline{A}_D$, which are simultaneously poles of the transfer function in frequency range. The natural values of the matrix can be determined as follows by calculating the zero points or the variables s of the characteristic polynomial p(s) from the determinate.

$$\det(s\underline{I}-\underline{A}_D)=0 \tag{29}$$

wobei $p(s)=\det(s\underline{I}-\underline{A}_D)$ $\underline{I}$ is the limit matrix. The application of (29), in the case of the selected condition space model according to equation 6-12, leads to a polynomial of the fourth order of the form:

$$p(s)=s^4+p_3s^3+p_2s^2+p_1s+p_0 \tag{30}$$

By feeding back the condition values through regulator matrix $\underline{K}_D$ to the control input, these natural values can be purposely skewed, since the position of the natural value is now determined by using the following determinates:

$$p(s)=\det(s\underline{I}-\underline{A}_D+\underline{B}_D\cdot\underline{K}_D) \tag{31}$$

Using (31), again leads to a fourth-order polynomial which, however, is now dependent on the regulator amplifications $k_{iD}$ (i=1 . . . 4). In the case of the model according to equations 6-12, (30) becomes $$p(s)=s^4+\frac{(ce-bdk_{4D}+dek_{2D})s^3}{ae-b^2}+\frac{(af-bdk_{3D}+dek_{1D})s^2}{ae-b^2}+\frac{(dk_{2D}f+cf)s}{ae-b^2}-\frac{dk_{1D}f}{ae-b^2} \tag{32}$$

It is now required that, as a result of the regulator amplifications $k_{iD}$, equation 31 and/or 32 accepts certain null points in order to affect the dynamic of the systems in a purposeful manner, which is reflected in the null points of this polynomial. As a result, there is a requirement for this polynomial in accordance with:

$$p(s)=\prod_{i=1}^{n}(s-r_i) \tag{33}$$

where n is the system order, which is to be set equal to the dimension of the condition vector. In the case of the model according to equation 6-12, n=4 and therefore p(s) is:

$$p(s)=(s-r_1)(s-r_2)(s-r_3)(s-r_4)=s^4+p_3s^3+p_2s^2+p_1s+p_0 \tag{34}$$

The poles $r_i$ are to be selected in such a manner that the system is stable, the regulation works sufficiently rapidly with good damping and the set value limitations are not reached in the typically occurring regulation deviations. The $r_i$'s can be determined according to these criteria in simulations before startup.

The regulating amplifications can now be determined through comparison of the coefficients of the polynomial equations 31 and 33.

$$\det(sI-\Delta_D+B_D\cdot K_D)\equiv\prod_{i=1}^{N}(s-r_i) \tag{35}$$

In the case of the model according to equations 6-12, a linear system of equations results, depending upon the regulation amplifications $k_{iD}$. The use of the system of equations leads to analytical mathematical expressions for regulation amplifications dependent upon the desires poles $r_i$ and the system parameters.

$$k_1=\frac{(r_1r_2\ r_4a\ e^2-e\ r_1r_2\ r_4b^2+r_1r_2r_3a\ e^2-e\ r_1r_2\ r_3b^2+r_2r_3\ r_4a\ e^2-e\ r_2r_3\ r_4b^2+r_1r_3\ r_4a\ e^2-e\ r_1r_3\ r_4b^2-r_2ae\ f+r_2b^2f-r_1ae\ f+r_1b^2\ f-r_4ae\ f+r_4b^2\ f-r_3ae\ f+r_3b^2\ f)}{bdf} \tag{36}$$

In the case of the model according to equations 6-12, the model parameters are $K_{PD}$, $i_D$, V, $\phi_A$, β, $J_T$, $J_{AZ}$, $m_A$, $s_A$, $m_L$, $I_A$, $I_S$, $b_D$. It is advantageous in this regulator design that now parameter changes of the system, such as cable length $I_S$, the angle of elevation $\phi_A$ or the load mass $m_L$ can be taken into account immediately in changed regulator amplifications. This is of decisive importance for an optimized regulation behavior.

In this manner, so that the regulation amplifications are calculated from the analytic expressions according to equation 36, even during operation, individual poles $r_i$ can be changed depending upon measured values, such as load mass $m_L$, cable length $I_S$, or angle of elevation $\phi_A$. The result of this is a very advantageous dynamic behavior.

As an alternative to this, a numerical design according to the design process of Riccati (see also O. Fölinger, Regulations Technology, 7th Edition, Hüthig Publishing House, Heidelberg, 1992) can be carried out and the regulating amplification is stored in look-up tables, depending on load mass, angle of elevation and cable length.

Since a complete condition regulator requires the knowledge of all condition values, it is advantageous to perform regulation as output feedback instead of a condition observer. This means that not all condition values are fed back through the regulator, but rather only those that are obtained from measurements. Thus, individual $k_{iD}$'s become zero. In the case of the model according to equations 6 through 12, for example, the measurement of the cable angle could be dispensed with. As a result, $k_{3D}=0$. The calculation of $k_{1D}$, $k_{2D}$ and $k_{4D}$ can nevertheless be made analogously to equation (36). Furthermore, it can make sense to calculate the regulating parameters for a single working point due to the not-insignificant calculation complications. However, subsequently the actual natural value situation of the system must be checked numerically with the regulator matrix $$\underline{K}_D=[k_{1D}k_{2D}0k_{4D}] \tag{37}$$

using the calculation according to equation 31. Since this can be done only numerically, the entire space covered by the changeable system parameters must be included. In this case, there would be the changeable system parameters $m_L$, $I_S$ and $\phi_A$. These parameters vary within the interval $[m_{Lmin}, m_{Lmax}]$, $[I_{Smin}, I_{Smax}]$ and $[\phi_{Amin}, \phi_{Amax}]$. That is, in these intervals, multiple support points $m_{LK}$, i and $\phi_{Aj}$ for all possible combinations of these changeable system parameters, the system matrix $\underline{A}_{ijk}(m_{LK}, I_i, \phi_{Aj})$ must be calculated and inserted in equation 31 and used with $\underline{K}_D$ from equation 37:

$$\det(s\underline{I}-\underline{A}_{ijk}+\underline{B}\cdot\underline{K}_D)\equiv 0 \text{ für alle i,j,k} \tag{38}$$

If all null points of (38) remain smaller than zero, then the stability of the system is proven and the original selected poles $r_i$ can be kept. If this is not the case, then a correction of the poles $r_i$ may become necessary according to equation (33).

Figure 7:
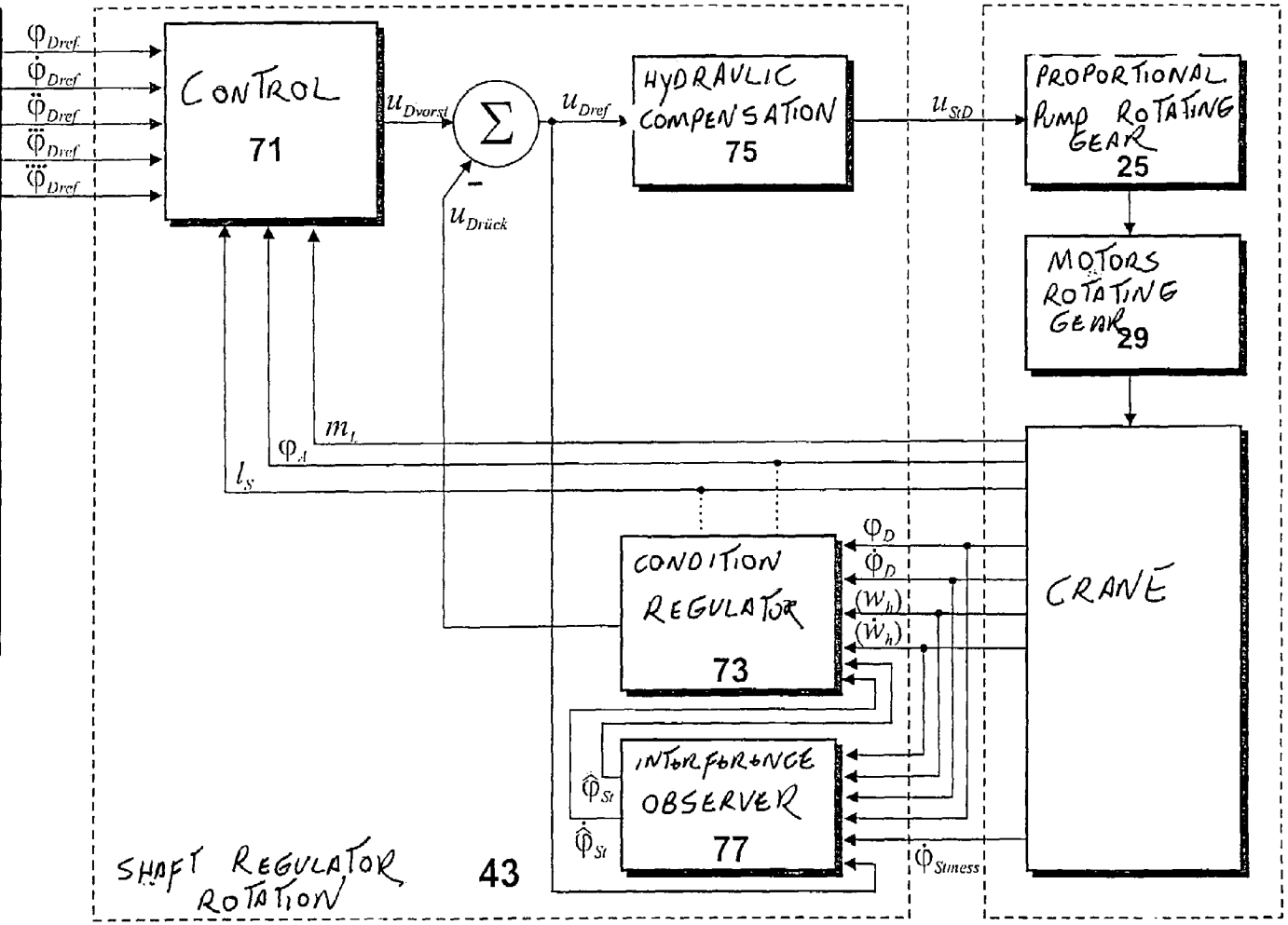
FIG. 7: Structure of the shaft regulator in the case of the rotating gear

If a condition value is not measurable, then it can be reconstructed from other measured values in an observer. In this connection, interference values caused by the measuring principle can be eliminated. In FIG. 7, this module is designated as interference observer 77. Depending upon which sensor system is used for the cable angle measurement, the interference observer is to be configured appropriately. If, for example, an acceleration sensor is used, then the interference observer must estimate the angle of swing from the swinging dynamics and the acceleration signal of the load. In an image processing system, it is necessary for the oscillations of the boom to be compensated for by the observer, so that a usable signal can be obtained. In measuring bending of the boom with expansion measuring stripes, the signal is to be abstracted by the observer from the reactive bending of the boom.

In the following, the measurement with a gyroscopic sensor on the load hook will be used to show the reconstruction of the cable angle and the cable angle speed.

$$\text{Condition vector: } \underline{x}_{Dz} = \begin{bmatrix} \varphi_D \\ \dot{\varphi}_D \\ \varphi_{St} \\ \dot{\varphi}_{St} \\ \dot{\varphi}_{Offset..D} \\ \varphi_{Ober..D} \\ \dot{\varphi}_{Ober..D} \end{bmatrix} \tag{39d}$$

$$\text{Input matrix: } \underline{B}_{Dz} = \begin{bmatrix} 0 \\ \frac{de}{ae-b^2} \\ 0 \\ \frac{-bd}{ae-b^2} \\ 0 \\ 0 \\ 0 \end{bmatrix}$$

$$\text{System matrix: } \underline{A}_{Dz} = \begin{bmatrix} 0 & 1 & 0 & 0 & 0 & 0 & 0 \\ 0 & -\frac{ce}{ae-b^2} & \frac{fb}{ae-b^2} & 0 & 0 & 0 & 0 \\ 0 & 0 & 0 & 1 & 0 & 0 & 0 \\ 0 & \frac{cb}{ae-b^2} & -\frac{af}{ae-b^2} & 0 & 1 & 0 & 0 \\ 0 & 0 & 0 & 0 & 0 & 0 & 0 \\ 0 & 0 & 0 & 0 & 0 & 0 & 1 \\ 0 & 0 & 0 & 0 & 0 & -w_1^2 & 0 \end{bmatrix}$$

$$\text{Interference observer matrix: } \underline{H}_{Dz} = \begin{bmatrix} h_{11D} & h_{12D} & h_{13D} \\ h_{21D} & h_{22D} & h_{23D} \\ h_{31D} & h_{32D} & h_{33D} \\ h_{41D} & h_{42D} & h_{43D} \\ h_{51D} & h_{52D} & h_{53D} \\ h_{61D} & h_{62D} & h_{63D} \\ h_{71D} & h_{72D} & h_{73D} \end{bmatrix}$$

$$\text{Observer output vector: } \underline{C}_{mDz} = \begin{bmatrix} 1 & 0 & 0 & 0 & 0 & 0 & 0 \\ 0 & 1 & 0 & 0 & 0 & 0 & 0 \\ 0 & 0 & 0 & 1 & 1 & 0 & 1 \end{bmatrix}$$

$$\text{Output vector of the measurement values: } \underline{y}_{mD} = \begin{bmatrix} \varphi_D \\ \dot{\varphi}_D \\ \varphi_{Stm} \end{bmatrix}$$

The determination of the observer amplifications $h_{ijD}$ is carried out either through transformation into observation normal form or through the design procedure of Riccati. It is essential, in this regard, that in the observer also changeable cable length, angle of elevation and load mass are taken into account by adapting the observer differential equation and the observer amplifications.

The estimation can advantageously be made even based on a reduced model. For this purpose, only the second equation of the model set according to equation 4, which describes the cable swing, is considered. $\ddot{\phi}_D$ is defined as an input to the interference observer, which can be calculated either from the measured value or $U_{Dref}$ (see equation 40). The reduced observer condition space model, taking the interference values into account, is then:

$$\underline{A}_{DZred} = \begin{bmatrix} 0 & 1 & 0 & 0 & 0 \\ -\frac{af}{ae-b^2} & 0 & 1 & 0 & 0 \\ 0 & 0 & 0 & 0 & 0 \\ 0 & 0 & 0 & 0 & 1 \\ 0 & 0 & 0 & -w_1^2 & 0 \end{bmatrix} \tag{39f}$$

$$\underline{B}_{dZred} = \begin{bmatrix} 0 \\ \frac{m_L \cdot l_A \cdot \cos\varphi_A}{m_L l_S} \\ 0 \\ 0 \\ 0 \end{bmatrix}$$

$$H_{dZred} = [\, h_{1red} \quad h_{2red} \quad h_{3red} \quad h_{4red} \quad h_{5red} \,]$$

$$\underline{x}_{Dzred} = \begin{bmatrix} \hat{\varphi}_{St} \\ \hat{\dot{\varphi}}_{St} \\ \hat{\varphi}_{Offset..D} \\ \hat{\varphi}_{Ober.D} \\ \hat{\dot{\varphi}}_{Ober..D} \end{bmatrix}$$

$$C_{mDZred} = [\, 0 \quad 1 \quad 1 \quad 0 \quad 1 \,]$$

$$y_{mDred} = \dot{\varphi}_{Stm}$$

$$\underline{u}_{DZred} = \ddot{\varphi}_D$$

The estimated value $\hat{\phi}_{St}$, $\hat{\dot{\phi}}_{St}$ from the reduced interference observer 771 (FIG. 7*a*) can either be fed directly to the condition regulator or, since the signal $\hat{\phi}_{St}$ from observer 771 is still overlaid with a slight offset, processed further in a second offset observer 773, which now assumes an offset $\hat{\phi}_{Offset}$ with respect to the angle signal $\hat{\phi}_{St}$. For this, $\hat{\dot{\phi}}_{Off}=0$ is assumed as interference model.

The basic model based on the second equation of (4) is then $$\underline{A}_{DOff} = \begin{bmatrix} 0 & 1 & 1 \\ -\frac{g}{l_S} & 0 & 0 \\ 0 & 0 & 0 \end{bmatrix}$$

$$\underline{x}_{DOff} = \begin{bmatrix} \hat{\varphi}_{St} \\ \hat{\dot{\varphi}}_{St} \\ \hat{\dot{\varphi}}_{Off} \end{bmatrix}$$

$$y_{mOff} = \hat{\varphi}_{St}$$

$$u_{DOff} = \ddot{\varphi}_D$$

-continued $$\underline{B}_{DOff} = \begin{bmatrix} 0 \\ -\frac{l_A \cos\varphi_A}{l_S} \\ 0 \end{bmatrix}$$

Figure 7A:
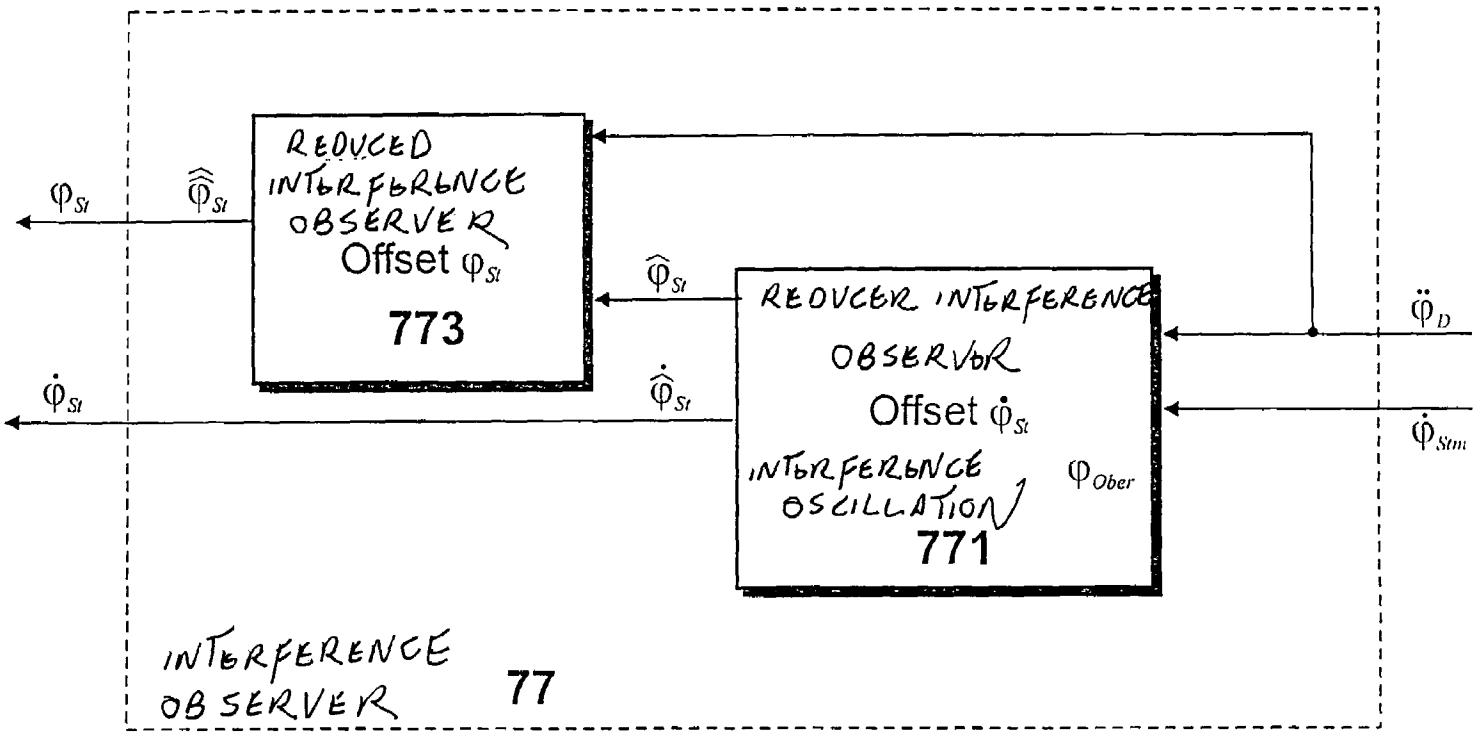

The observer amplifications are determined by setting poles as in the regulator design (equation 29 ff.). The resulting structure for the two-stage reduced observer is represented in FIG. 7*a*. This variant assures still better compensation of the offset to the measured value and better estimate for $\phi_{St}$ and $\dot{\phi}_{St}$.

The estimated values $\hat{\phi}_{St}$, $\hat{\dot{\phi}}_{St}$ and $\hat{\dot{\phi}}_{St}$ are fed back to the condition regulator. As a result, we obtain at the output of the condition regulator block 73, with the feedback of $\phi_D$, $\dot{\phi}_D$, $\hat{\phi}_{St}$, $\hat{\dot{\phi}}_{St}$, then $$u_{Druck}=k_{1D}\phi_D+k_{2D}\dot{\phi}_D+k_{3D}\hat{\phi}_{St}+k_{4D}\hat{\dot{\phi}}_{St} \tag{39e}$$

The desired starting voltage of the proportional valve for the rotating gear, taking into account the control 71, is then $$u_{Drej}=u_{Dvorst}-u_{Drück} \tag{40}$$

Since in the condition space model according to equations 6-12 only linear system parts can be taken into account, optionally static non-linearities of the hydraulics in block 75 of the hydraulic compensation can be taken into account in such a manner as to result in a linear system behavior with respect to the system input. The essential non-linear effects of the hydraulics are the dead spot of the proportional valve at the zero point and hysteresis effects of the underlying supply flow regulation. For this, experimentally the static graph between starting voltage $U_{StD}$ of the proportional valve and the resulting supply flow $Q_{FD}$ is recorded. The graph can be described by a mathematical function.

$$Q_{FD}=f(u_{StD}) \tag{41}$$

With respect to the system input, now linearity is required. That is, the proportional valve and the block of the hydraulic compensation, summarized according to equation (5), should have the following transfer behavior.

$$Q_{FD}=K_{PD}u_{StD} \tag{42}$$

If the compensation block 75 has the static graph $$u_{StD}=h(u_{Dref}), \tag{43}$$

then condition (42) is fulfilled precisely if $$h(u_{Dref})=f^{-1}(K_{PD}u_{Dref}) \tag{44}$$

is selected as static compensation graph.

With this, the individual components of the shaft regulator for the rotating gear are explained. As a result, the combination of path planning module and shaft regulator for the rotating gear fulfill the requirements of a swing-free movement of the load precisely on the path.

Figure 9:
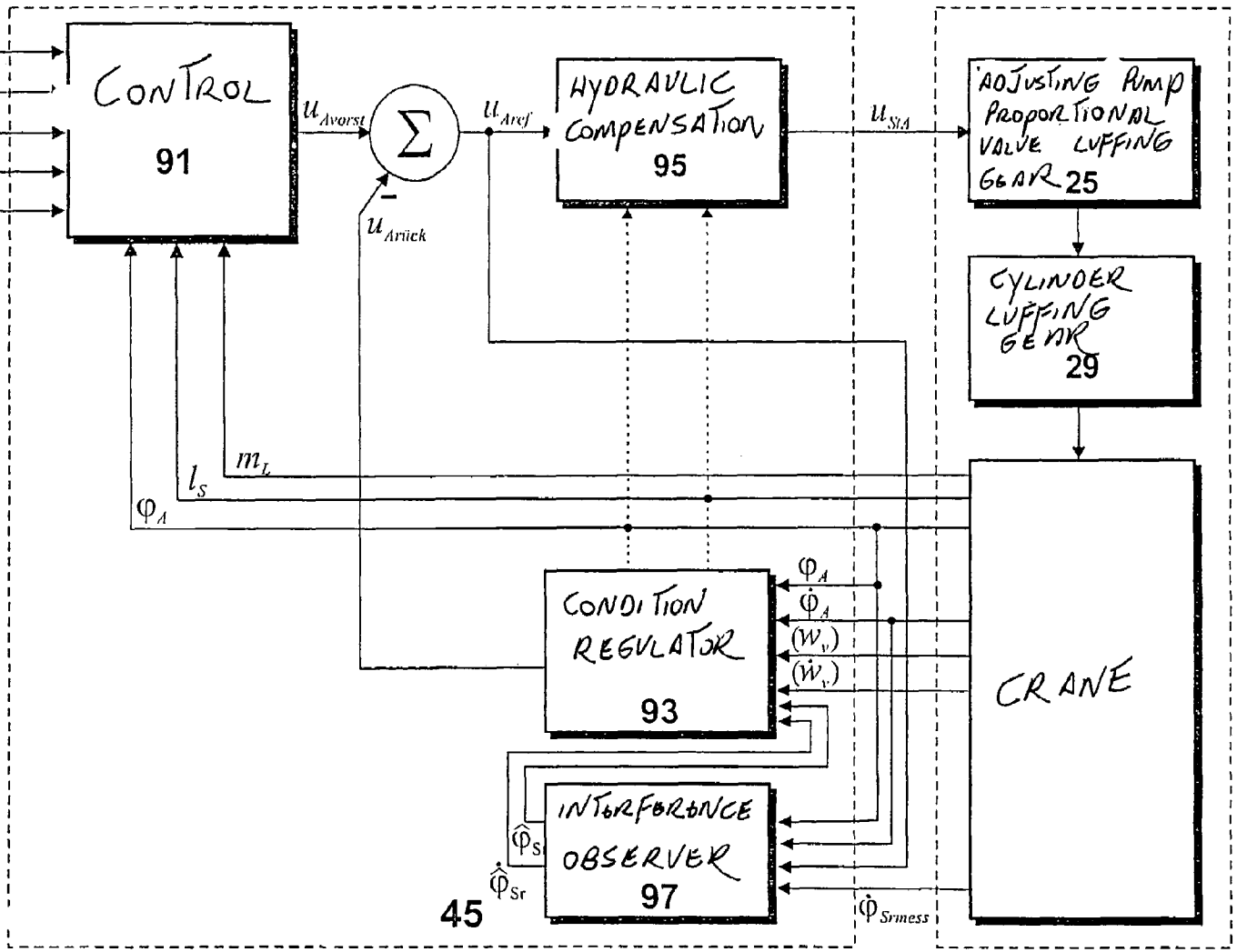
FIG. 9: Structure of the shaft regulator in the case of the luffing gear

Building on these results, the shaft regulator for the luffing gear 7 will now be explained. FIG. 9 shows the basic structure of the shaft regulator for the luffing gear.

The beginning functions of the path planning module in the form of the desired load position, expressed in a radial direction, as well as its derivatives (speed, acceleration, jerk and derivative of the jerk) are input into the control block 91 (block 71 in the rotating gear). In the control block, these functions are amplified in such a manner that, as a result, the load travels precisely on path, without swinging, under the idealized conditions of the dynamic model. The basis for the determination of the control amplifications is the dynamic model, which, in the following sections, are derived for the luffing gear. As a result, under these idealized conditions, the swinging of the load is suppressed and the load follows the generated path.

As in the rotating gear, in order to regulate out interference (for example, wind effects) and compensate for model errors, optionally the control can be supplemented with a condition regulating block 93 (cf. rotating gear 73). In this block, at least one of the measuring values angle of elevation $\phi_A$, angular speed of elevation $\dot{\phi}_A$, bending of the boom in the vertical direction $w_V$, the derivation of the vertical bending $\dot{w}_V$, the radial cable angle $\phi_{Sr}$, or the radial cable angular speed $\dot{\phi}_{Sr}$ can be amplified and fed back to the setting input. The derivative of the measurement values $\phi_A$, $\phi_{Sr}$ and $w_V$ is numerically determined in the microprocessor control.

Due to the dominant static non-linearity of the hydraulic drive units (hysteresis, dead spot), the value obtained from the control $u_{Avorst}$ and optional condition regulator output $U_{Arück}$ for the setting input $U_{Aref}$ in the hydraulic compensation block 95 (analogous to block 75) is changed, so that as a result a linear behavior of the overall system can be assumed. The output of block 95 (hydraulic compensation) is the corrected setting value $U_{StA}$. This value is then supplied to the proportional valve of the hydraulic circulation for the cylinder of the luffing gear.

For detailed explanation of the procedure, the derivation of the dynamic model for the luffing gear should now serve, which is the basis for the calculation of the control amplifications, the condition regulator and the interference observer.

Figure 10:
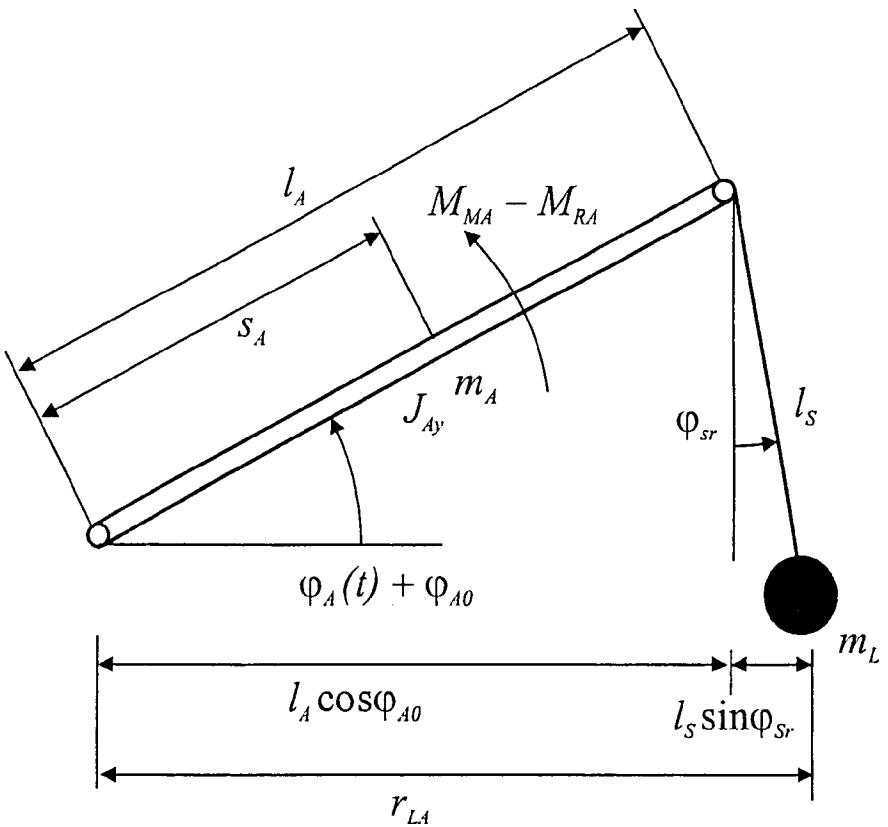
FIG. 10: Mechanical structure of the luffing gear and definition of model variables

For this, FIG. 10 shows explanations to define the model variables. What is essential there is the relationship shown between the elevation angle position $\phi_A$ of the boom and the load position in the radial direction $r_{LA}$ $$r_{LA}=l_A\cos\phi_A+l_S\sin\phi_{Sr} \tag{45}$$

However, for the regulation behavior, it is the small signal behavior that is decisive. Therefore, equation (45) is linearized and a work point $\phi_{A0}$ is selected. The radial deviation is then defined as a regulating value.

$$\Delta r_{LA}=-l_A\phi_A\sin\phi_{A0}+l_S\sin\phi_{Sr} \tag{45a}$$

The dynamic system can be described through the following differential equations.

$$\begin{aligned}&(J_{AY}+m_As^2{}_A-m_Ll_A{}^2\sin^2\phi_{A0})\ddot{\phi}_A-m_Ll_Al_s\sin\phi_{A0}\\&\quad\ddot{\phi}_{sr}+b_A\phi_A-m_As_Ag\sin\phi_{A0}\cdot\phi_A=M_{MA}-M_{RA}-m_As_Ag\cos\phi_{A0}\end{aligned} \tag{46}$$

$$\begin{aligned}&-m_Ll_Al_s\sin\phi_{A0}\ddot{\phi}_A+m_Ll_s{}^2\\&\quad\ddot{\phi}_{sr}+m_Ll_s g\phi_{sr}=m_Ll_s\phi_D{}^2(l_S\phi_{sr}+l_A\cos\phi_{A0})\end{aligned}$$

Definitions:

| | |
|---|---|
| $m_L$ | load mass |
| $l_S$ | cable length |
| $m_A$ | boom mass |
| $J_{AY}$ | moment of inertia of the mass with respect to the center of gravity when rotating along horizontal axis including drive cable |
| $l_A$ | length of boom |
| $s_A$ | distance of center of gravity of the boom |
| $b_A$ | viscous damping |
| $M_{MA}$ | moment of drive |
| $M_{RA}$ | moment of friction |

The first equation of (4) describes essentially the movement equation of the boom with the driving hydraulic cylinder, where the reaction through the swinging of the load is taken into account. At the same time, the effects of gravity on the boom and the viscous friction in the drive are taken into account as well. The second equation of (4) is the movement equation, which describes the load swing $\phi_{Sr}$, where the excitation of the load swing is caused by the elevation or depression of the boom through the angular acceleration of the boom or an outside factor, expressed through the beginning conditions for these differential equations. The term on the right side of the differential equation describes the effect of centripetal force on the load when turning the load with the rotating gear. As a result, a typical problem for a rotary crane is described, since there exists with this a coupling between the rotating gear and the luffing gear. Obviously, this problem can be described by the fact that a movement of the rotating gear causes an angular deflection in the radial direction with a quadratic speed ratio. If the load is to be moved precisely along a path, this problem must be taken into account. First, this effect is set to 0. After the components of the shaft regulator are explained, the coupling point between the rotating gear and the luffing gear will be taken up again and solution possibilities shown.

The hydraulic drive is described by the following equations.

$$\begin{aligned}M_{MA}&=F_{Zyl}d_b\cos\varphi_p(\varphi_A)\\F_{Zyl}&=p_{Zyl}A_{Zyl}\\\dot{p}_{Zyl}&=\frac{2}{\beta V_{Zyl}}(Q_{FA}-A_{Zyl}\dot{z}_{Zyl}(\varphi_A,\dot{\varphi}_A))\\Q_{FA}&=K_{PA}u_{StA}\end{aligned} \tag{47}$$

$F_{Zyl}$ is the force of the hydraulic cylinder on the piston rod, $p_{Zyl}$ is the pressure in the cylinder (depending upon direction of movement, the piston side or the ring side), $A_{Zyl}$ is the cross-sectional surface area of the cylinder (depending upon direction of movement, the piston side or the ring side), $\beta$ is the compressibility of the oil, $V_{Zyl}$ is the cylinder volume, $Q_{FA}$ is the supply stream in the hydraulic circuit for the luffing gear and $K_{PA}$ is the proportionality constant that indicates the relationship between the supply stream and the start voltage of the proportional valve. Dynamic effects of the underlying supply current regulation are ignored. In the case of the oil compression cylinder, half of the total volume of the hydraulic cylinder is assumed to be the relevant cylinder volume. $z_{Zyl}$, $\dot{z}_{Zyl}$ are the position and the speed of the cylinder rod. These are dependent on the elevation kinetics, as are the geometric parameters $d_b$ and $\phi_p$.

Figure 11:
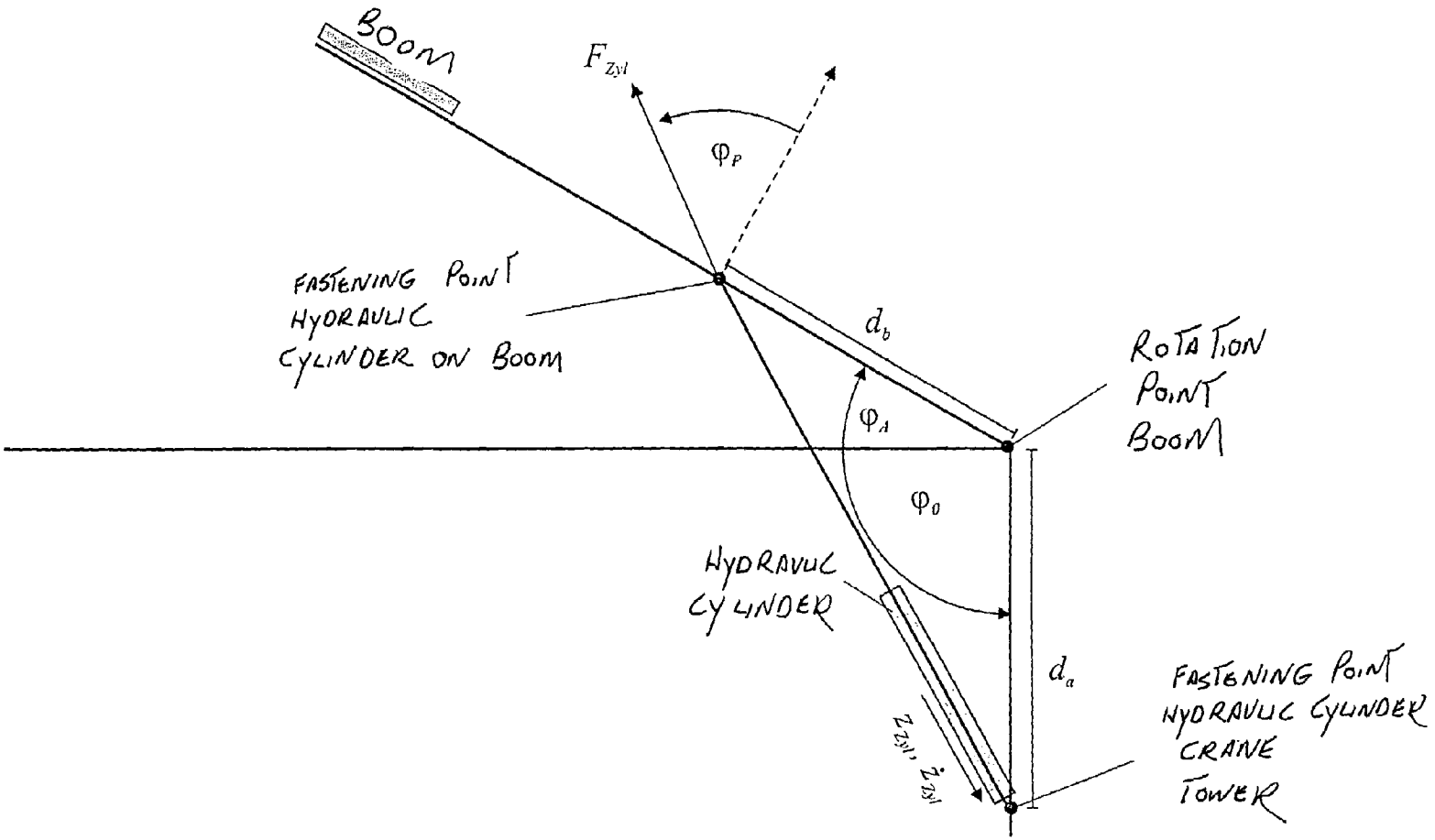
FIG. 11: Erection kinetics of the luffing gear

In FIG. 11, the elevation kinetics of the luffing gear are represented. For purposes of an example, the hydraulic cylinder is anchored at the lower end of the crane tower. The distance $d_a$ between this point and the point of rotation of the boom can be taken from design data. The piston rod of the hydraulic cylinder is fastened to the boom at a distance $d_b$. $\phi_0$ is also known from design data. From this, the following relationship between the elevation angle $\phi_A$ and the hydraulic cylinder position $z_{Zyl}$ can be derived.

$$z_{Zyl}=\sqrt{d_a^2+d_b^2-2d_bd_a\cos(\varphi_A+\varphi_0)} \tag{48}$$

Since only the elevation angle $_A$ is a measured, the inverse relation of (48) as well as the dependence between the piston rod speed $\dot{z}_{Zyl}$ and the elevation speed $\dot{\phi}_A$ are also of interest.

$$\varphi_A = \arccos\left(\frac{d_a^2 + d_b^2 - z_{Zyl}^2}{2d_a d_b}\right) - \varphi_0 \tag{49}$$

$$\dot{\varphi}_A = \frac{\partial \varphi_A}{\partial z_{Zyl}} \dot{z}_{Zyl} = \frac{\sqrt{d_a^2 + d_b^2 - 2d_b d_a \cos(\varphi_A + \varphi_0)}}{d_b d_a \sin(\varphi_A + \varphi_0)} \dot{z}_{Zyl} \tag{50}$$

For the calculation of the effective moment of the boom, it is also necessary to calculate the projection angle $\phi_p$.

$$\cos\varphi_p = \frac{d_a \sin(\varphi_A + \varphi_0)}{\sqrt{d_a^2 + d_b^2 - 2d_b d_a \cos(\varphi_A + \varphi_0)}} = \frac{h_1}{h_2} \tag{51}$$

For a compact notation, the auxiliary variables $h_1$ and $h_2$ are introduced into equation 51. As a result, the dynamic model of the luffing gear described in equations 46-51 can now be transformed into the condition space representation (see also O. Fölinger: Regulation Technology, 7th Edition, Hüthig Publishing House, 1992). Since linearity is a precondition, first the centripetal power coupling term with the rotating gear based on the rotating speed $\phi_D$ is ignored. Furthermore, the portions of equation 46 that are based on gravitation are set to zero. The following condition space representation of the system results.

$$\text{Condition space representation: } \dot{\underline{x}}_A = \underline{A}_A \underline{x}_A + \underline{B}_A \underline{u}_A \tag{52}$$

$$\underline{y}_A = \underline{C}_A \underline{x}_A$$

with $$\text{Condition vector: } \underline{x}_A = \begin{bmatrix} \varphi_A \\ \dot{\varphi}_A \\ \varphi_{Sr} \\ \dot{\varphi}_{Sr} \end{bmatrix} \tag{53}$$

$$\text{Control value: } u_A = u_{StA} \tag{54}$$

$$\text{Output value: } y_A = r_{LA} \tag{55}$$

$$\text{System matrix: } \underline{A}_A = \begin{bmatrix} 0 & 1 & 0 & 0 \\ 0 & -\frac{fc}{af - b^2} & \frac{bg_g}{af - b^2} & 0 \\ 0 & 0 & 0 & 1 \\ 0 & \frac{bc}{af - b^2} & -\frac{ag_g}{af - b^2} & 0 \end{bmatrix} \tag{56}$$

$$a = J_{AY} + m_A S_A^2 + m_L l_A^2 \sin(\varphi_A)^2$$
$$b = m_L l_A \sin(\varphi_A) l_S$$
$$c = b_A + \frac{A_{zvl}^2 d_b^2 h_1^2}{\beta V_{zvl} h_2^2}$$
$$e = \frac{K_{PA} A_{zvl} d_b h_1}{\beta V_{zyl} h_2}$$
$$f = m_L l_S^2$$
$$g_\varepsilon = m_L g l_s$$

-continued $$\text{where: } h_1 = \sqrt{d_a^2 + d_b^2 - 2d_b d_a \cos(\varphi_A + \varphi_0)} \tag{66}$$
$$h_2 = d_a \sin(\varphi_A + \varphi_0)$$

$$\text{Control vector: } \underline{B}_A = \begin{bmatrix} 0 \\ \frac{fe}{af - b^2} \\ 0 \\ \frac{be}{af - b^2} \end{bmatrix} \tag{57}$$

$$\text{Output vector: } \underline{C}_A = [\,-l_A \sin(\varphi_{A0}) \;\; 0 \;\; l_S \;\; 0\,] \tag{58}$$

The dynamic model of the luffing gear is understood as a parameter changeable system with respect to the cable length $l_S$ and the trigonometric function portions of the boom angle $\phi_A$ as well as the load mass $m_L$. Equations (52) through (58) are the basis for the design now described of the control 91, the condition regulator 93 and the interference observer 97.

Input values of the control block 91 are the desired position $r_{LA}$, the desired speed $\dot{r}_{LA}$, the desired acceleration $\ddot{r}_{LA}$, the desired jerk $\dddot{r}_{LA}$ and the derivative of the desired jerk $r_{LA}^{(IV)}$. The guide value vector $\underline{w}_A$ is analogous to (13).

$$\underline{w}_A = \begin{bmatrix} r_{LAref} \\ \dot{r}_{LAref} \\ \ddot{r}_{LAref} \\ \dddot{r}_{LAref} \\ r_{LAref}^{(IV)} \end{bmatrix} \tag{59}$$

The components of $\underline{w}_A$ are weighted in the control block 91 with the control amplifications $K_{VA0}$ through $K_{VA4}$ and their sum is supplied to the setting input. If the shaft regulator for the elevation shaft does not include a condition regulating block 93, then the value $U_{Avrost}$ from the control block is equal to the reference starting voltage $U_{Aref}$, which is fed to the proportional valve after compensation for the hydraulic non-linearity as a starting voltage $U_{StA}$. The condition space representation (52) is therefore expanded analogously to (14) to $$\dot{\underline{x}}_A = \underline{A}_A \underline{x}_A + \underline{B}_A \underline{S}_A \underline{w}_A \tag{60}$$

$$\underline{y}_A = \underline{C}_A \underline{x}_A$$

with the control matrix $$\underline{S}_A = \{K_{VA0} K_{VA1} K_{VA2} K_{VA3} K_{VA4}\}. \tag{61}$$

If the matrix equation (60) is applied, then it can be written as an algebraic equation for the control block, where $U_{Avorst}$ is the uncorrected desired starting voltage for the proportional valve based on the idealized model.

$$u_{Avorst} = K_{VA0} r_{LAref} + K_{VA1} \dot{r}_{LAref} - K_{VA2} \ddot{r}_{LAref} + K_{VA3} \dddot{r}_{LAref} + K_{VA4} r_{LAref}^{(IV)} \tag{62}$$

$K_{VA0}$ through $K_{VA4}$ are the control amplifications, which are calculated depending upon the current angle of elevation $\phi_A$, the load mass $m_L$ and the cable length $l_S$, so that the load follows the desired trajectory precisely on path without swinging.

The control amplifications $K_{VA0}$ through $K_{VA4}$ are calculated as follows. With respect to the regulating value of the radial load position $r_{LA}$, the transfer function can be given without a control block as follows from the condition equations (52) through (58) in accordance with the relationship $$G(s) = \frac{r_{LA}(s)}{u_{Avorst}(s)} = \underline{C}_A(s\underline{I} - \underline{A}_A)^{-1}\underline{B}_A \tag{63}$$

Thus, using equation (63), the transfer function between the output of the control block and the load position can be calculated. Taking into account the control block (91) in equation (63), one obtains a relationship which, after multiplying out, has the form $$\frac{r_{LA}}{r_{LAref}} = \frac{\ldots\ b_2(K_{VAi})\cdot s^2 + b_1(K_{VAi})\cdot s + b_0(K_{VAi})}{\ldots\ a_2\cdot s^2 + a_1\cdot s + a_0}. \tag{64}$$

Only the coefficients $b_4$ to $b_0$ and $a_4$ to $a_0$ are of interest for calculating the amplifications $K_{Vai}$ ($K_{VA0}$ through $K_{VA4}$). An ideal system behavior with respect to position, speed, acceleration, jerk and the derivative of the jerk results precisely, when the transfer function of the entire system of control and transfer function of the luffing gear meets the conditions of equation (21) for the coefficients $b_i$ and $a_i$.

This again provides a linear system of equations that can be solved in analytical form for the control amplifications $K_{VA0}$ through $K_{VA4}$.

For the case of a model according to equations 52 through 58, there then results, analogously to the manner of computing in the rotating gear (equations 18-23) for the control amplifications $$K_{VA0} = 0 \tag{65}$$

$$K_{VA1} = \frac{-c}{el_A\ \sin(\varphi_{A0})}$$

$$K_{VA2} = -\frac{ag_g(af - b^2)}{el_A\sin\varphi_{A0}(fag_g - b^2g)}$$

$$K_{VA3} = \frac{-b(l_Sb^2c - l_Safc)}{(el_A^2\sin(\varphi_{A0})^2(fag_g - b^2g))}$$

$$K_{VA4} = \frac{b(a^2f^2l_A\ \sin(\varphi_A)bg - l_Sa^2f^2g_g - l_gb^4ag_g + 2l_Sb^2a^2fg_g - 2afb^3l_A\sin(\varphi_A)g + b^3l_A\ \sin(\varphi_A)g)}{el_A^2\sin(\varphi_A)^2(-2fag_gb^2g + b^4g^2 + f^2a^2g_g^2)}$$

As already shown in the case of the rotating gear, this has as an advantage the fact that the control amplifications are present as a function of the model parameters. In the case of the model according to equations 52 through 58, the system parameters $J_{AY}$, $m_A$, $s_A$, $I_A$, $m_L$ are trigonometric terms of $\phi_A$, $I_S$, $b_A$, $K_{PA}$, $A_{Zyb}$ $\beta$, $d_b$, and $d_a$.

Thus, the change of model parameters such as the angle of elevation $\phi_A$, the load mass $m_L$ and the cable length $I_S$, can be taken into account immediately in the change of the control amplifications. Thus, these can always be followed up on as a function of the measured values. That is, if the lifting gears are used to change the cable length $I_S$, then the control amplifications are automatically changed thereby so that, as a result, the swing damping behavior of the control is preserved as the load is moved.

The parameters $J_{AY}$, $m_A$, $s_A$, $I_A$, $K_{PA}$, $A_{Zyl}$, $V_{Zyl}$, $\beta$, $d_b$, and $d_a$ are available from the technical data sheet. In principle, parameters $I_S$, $m_L$ and $\phi_A$ are determined as sensor data from changeable system parameters. The damping parameter $b_A$ is determined from frequency change measurements.

With the control block, it is now possible to start the luffing gear of the crane in such a manner that under the idealized condition of the dynamic model according to equations 52 through 58, the load does not swing when the luffing gear is moved and the load follows precisely the path generated by the path planning module. The dynamic model is, however, only an abstract reflection of the actual dynamic conditions. Furthermore, interference factors from outside may affect the crane (for example, wind effects or the like).

For this reason, the control block 91 is supported by a condition regulator 93. In the condition regulator, at least one of the measured values $\phi_{St}$, $\dot{\phi}_{St}$, $\phi_D$, $\dot{D}_D$ is weighted with a regulation amplification and fed back to the setting input. There, the difference between the output value of the control block 91 and the output value condition regulator block 93 is determined. If the condition regulator block is present, it must be taken into account in the calculation of the control amplifications.

As a result of the feedback, equation (60) is changed to $$\underline{\dot{x}}_A = (\underline{A}_A - \underline{B}_A\underline{K}_A)\underline{x}_A + \underline{B}_A\underline{S}_A\underline{w}_A \tag{67}$$

$$\underline{y}_A = \underline{C}_A\underline{x}_A$$

$\underline{K}_A$ is the matrix of the regulator amplifications of the condition regulator of the luffing gear analogous to the regulating matrix $\underline{K}_D$ in the rotating gear. Analogously to the method of calculation in the rotating gear from equations 25 through 28, the description transfer function is changed to $$G_{AR}(s) = \frac{r_{LA}(s)}{u_{Avorst}(s)} = \underline{C}_A(s\underline{I} - \underline{A}_A + \underline{B}_A\underline{K}_A)^{-1}\underline{B}_A \tag{68}$$

In the case of the axis of elevation, for example, the values $\phi_{St}$, $\dot{\phi}_{St}$, $\phi_D$, $\dot{\phi}_D$ can be fed back. The corresponding regulating amplifications of $\underline{K}_A$ are, for this purpose, $k_{1A}$, $k_{2A}$, $k_{3A}$, $k_{4A}$. After taking into account the control 91 in equation 68, the control amplifications $K_{VA1}$ ($K_{VA0}$ through $K_{VA4}$) can be calculated according to the conditions of equation 21.

This again leads to a linear system of equations analogous to equation 22, which, in analytical form, can be solved for the control amplifications sought, $K_{VA0}$ through $K_{VA4}$. It should, however, be noted that the coefficients $b_i$ and $a_i$, in addition to the control amplifications sought, $K_{VA0}$ through $K_{VA4}$, are now also functions of the known regulation amplifications is $k_{1A}$, $k_{2A}$, $k_{3A}$, $k_{4A}$ of the condition regulator.

For the control amplifications $K_{VA0}$ through $K_{VA4}$ of the control block 91, we obtain, taking into account the condition regulator block 93, analogously to equation 28 in the case of the rotation axis:

$$K_{VA0} = \frac{k_{1A}}{l_A\sin(\varphi_{A0})}\cdot(-1) \tag{69}$$

$$K_{VA1} = \frac{c + ek_{2A}}{el_A\sin(\varphi_{A0})}\cdot(-1)$$

$$K_{VA2} = \frac{-(afbek_2l_A\sin(\varphi_A) - b^2ag_gl_A\ \sin(\varphi_A) - b^3ek_{2A}l_A\ \sin(\varphi_A) + a^2fg_gl_A\ \sin(\varphi_A) - el_gb^3k_{1,3} + el_Abafk_A)}{(el_A^2\sin(\varphi_{A0})^2(fag_g - b^2g))}$$

$$K_{VA3} = \frac{-b(afek_{4A}l_A\sin(\varphi_A) - b^2ek_{4A}l_A\sin(\varphi_A) - l_Sb^2\ c - l_s\ b^2\ ek_{2A} + l_Safc + l_Sa\ fek_{2A})}{(el_A^2\sin(\varphi_{A0})^2(fag_g - b^2g))}$$

-continued $$K_{VA4} = \frac{\begin{array}{c} -b(l_S ba^2\ f^2 ek_{3A} l_A \sin(\varphi_A) el_S\, k_{1A} - f^3 a^2 l_A^2 \sin(\varphi_A)^2\, e\, k_{3A} + \\ l_S^2 ba^2\ f^2 ek_{1A} + l_S a^3\ f^2 g_g\ l_A \sin(\varphi_A) - \\ 2l_S\ b^3\ afek_{3A} l_A \sin(\varphi_A) + l_S\ b^4\ ag_g l_A \sin(\varphi_A) + \\ l_S b^5\ ek_{3A} l_A \sin(\varphi_A) - \\ 2l_S b^2 a^2 fg_g\ l_A \sin(\varphi_A) - 2l_S^2 b^3 eafek_{1A} - fb^4 l_A\ \sin(\varphi_A) el_S k_{1A} + \\ 2f^2 b^2 l_A\ \sin(\varphi_A) el_S\ k_{1A} + 2f^2 b^2 l_A^2 \sin(\varphi_A)^2\ ae\, k_{3A} - \\ fb^4 l_A^2 \sin(\varphi_A)^2 e\, k_{3A} + 2afb^3 l_A^2 \sin(\varphi_A)^2 g - b^5\ l_A^2 \sin(\varphi_A)^2 g + \\ l_A^2 b^5\ e\, k_{1A} - a^2\ f^2\ l_A^2 \sin(\varphi_A)^2 bg \end{array}}{(el_A^3 \sin(\varphi_A)^3 (-2fag_g\ b^2 g + b^4 g^2 + f^2 a^2 g_g^2))}$$

With equation (69), the control amplifications are known, which assure a swing-free travel, precisely on track, of the load in the rotating direction, based on the idealized model and taking into account the condition regulator block 93. It should be noted that the centripetal force term in the model statement for equation 68 was ignored and therefore also not taken into account in the control. Here, it applies as well that already upon applying the first derivative of the desired function the dynamic behavior improves, and by mixing in the higher derivatives, greater improvement can be achieved step by step. Now the condition regulator amplifications $k_{1A}$, $k_{2A}$, $k_{3A}$, $k_{4A}$ are to be determined. This will be explained in the following.

The regulation feedback 93 is designed as a condition regulator. The regulator amplifications are calculated analogously to the calculation method of equations 29 through 39 for the rotating gear.

The components of the conditioning vector $\underline{x}_A$ are weighted with the regulating amplifications $k_{iA}$ of the regulator matrix $\underline{K}_A$ and fed back to the setting input of the segment.

As in the case of the rotating gear, the regulating amplifications are determined by means of coefficient comparison of the polynomials analogously to equation 35

$$\det(s\underline{I} - \underline{A}_A + \underline{B}_A \cdot \underline{K}_A) \equiv \prod_{i=1}^{n} (s - r_i) \tag{69a}$$

Since the model of the luffing gear, like that of the rotating shaft, has an order n=4, then there results, for the characteristic polynomial p(s) of the luffing gear, analogous to equations 30, 31, 32 in the rotating gear $$p(s) = \tag{69b}$$

$$s^4 + \frac{(afbek_{4A} - b^3 ek_{4A} + f^2 ca - fcb^2 + f^2 ek_{2A} a - fek_{2A} b^2)s^3}{(af - b^2)^2} + \frac{(-fek_{4A} b^2 + afbek_{3A} - b^2 ag_g + a^2 fg_g - b^3 ek_{3A} + f^2 ek_{1A} a)s^2}{(af - b^2)^2} + \frac{(fcag_g + fek_{2A} ag_g - cb^2 g - ek_{2A}\ b^2 g)s}{(af - b^2)^2} + \frac{fek_{1A} ag_g - b^2 ek_{1A} g}{(af - b^2)^2}$$

The coefficient comparison with the pole prescribing polynomial according to equation 35 again leads to a linear system of equations for the regulating amplifications $k_{iA}$.

The poles $r_i$ of the pole prescribing polynomial are then selected in such a manner that the system is stable, the regulation works sufficiently rapidly with good damping and the setting value limitation is not reached with typically occurring regulation deviations. The $r_i$'s can be determined before a startup in simulations according to these criteria.

Analogously to equation 365, the regulating amplifications are determined on analytical mathematical expressions for the regulator amplifications as functions of the desired poles $r_i$ and the system parameters. As in rotation, it can be advantageous to vary the pole location as a function of measured values of load mass, cable length and angle of elevation. In the case of the model according to equations 52 through 58, the system parameters are $J_{AY}$, $m_A$, $s_A$, $I_A$, $m_L$, $I_S$, $b_A$, $K_{PA}$, $A_{Zyl}$, $V_{Zyl}$, $\beta$, $d_b$, $d_a$. As in the case of the rotating gear, now parameter changes of the system, such as cable length $I_S$, load mass $m_L$ or the angle of elevation $\phi_A$, can immediately be taken into account in changed regulation amplifications. This is of decisive importance for an optimized regulating behavior.

Alternatively to this, a numerical design can be carried out in accordance with the design procedure of Riccati (see also O. Föllinger: Regulating Technology, 7th Edition, Hüthig Publishing House, Heidelberg, 1992) and the regulator amplifications can be stored in look-up tables as functions of load mass, angle of elevation and cable length.

As in the case of the rotation gear, the regulation can be done as output feedback. In this regard, individual $K_{iA}$ are set to zero. The calculation is then done analogously to equations 37 through 38 of the rotation gear.

If a condition value is not measurable, it can be constructed from other measured values in an observer. In this manner, interference values caused by the measuring principle can be eliminated. In FIG. 9, this module is designated as interference observer 97. Depending upon which sensor system is used for the cable angle measurement, the interference observer is to be suitably configured. In the following, the measurement will again be made by a gyroscopic sensor on the load hook and the reconstruction of the cable angle and the cable angular speed will be shown. In this connection, an additional problem arises in the form of the stimulation of nodding swinging of the load hook, which also must be eliminated by the observer or suitable filter techniques.

The gyroscopic sensor measures the angle of speed in the corresponding sensitivity direction. Through a suitable choice of the place of installation on the load hook, the sensitivity direction corresponds to the direction of the radial angle $\phi_{St}$. The interference observer now has the following tasks:

1) correction of the offset caused by the measuring principle to the measured signal
2) offset-compensated integration of the measured angle speed signal to the angle signal
3) elimination of the over-swings on the measured signal, which are caused by over-swinging of the cable.
4) elimination of the nodding swings through a suitable interference model.

The offset error $\dot{\phi}_{Offset}$ is again assumed to be constant in segments.

$$\ddot{\phi}_{Offset,w} = 0 \tag{70}$$

To eliminate the nodding swinging of the hook, the resonance frequency $w_{Nick,w}$ is determined experimentally. The corresponding swing differential equation corresponds to equation 39b $$\ddot{\phi}_{Nick,w} = -w_{Nick,w}^2 \phi_{Nick,w} \tag{71}$$

The condition space representation of the partial model for the luffing gear according to equations 52-58 is expanded by the interference model. In this case, a complete observer is derived. The observer equation for the modified condition space model therefore reads:

$$\dot{\hat{\underline{x}}}_{Az}=(\underline{A}_{Az}-\underline{H}_{Az}\underline{C}_{mAz})\cdot\underline{x}_{Az}+\underline{B}_{Az}\cdot\underline{u}_A+\underline{H}_{Az}\underline{y}_{Zm} \tag{72a}$$

where the following matrices are carried out as a supplement to equations 52-58.

$$\text{Condition vector: } \underline{x}_{Dz}=\begin{bmatrix}\varphi_A\\ \dot{\varphi}_A\\ \varphi_{Sr}\\ \dot{\varphi}_{Sr}\\ \dot{\varphi}_{Offset..w}\\ \varphi_{Nick.w}\\ \dot{\varphi}_{Nick.w}\end{bmatrix}$$

$$\text{Input matrix: } \underline{B}_{Az}=\begin{bmatrix}0\\ \frac{fe}{af-b^2}\\ 0\\ \frac{be}{af-b^2}\\ 0\\ 0\\ 0\end{bmatrix}$$

$$\text{System matrix: } \underline{A}_{AZ}= \tag{72b}$$

$$\begin{bmatrix}0 & 1 & 0 & 0 & 0 & 0 & 0\\ 0 & -\frac{fc}{af-b^2} & -\frac{bg_g}{af-b^2} & 0 & 0 & 0 & 0\\ 0 & 0 & 0 & 1 & 0 & 0 & 0\\ 0 & -\frac{bc}{af-b^2} & \frac{ag_g}{af-b^2} & 0 & 1 & 0 & 0\\ 0 & 0 & 0 & 0 & 0 & 0 & 0\\ 0 & 0 & 0 & 0 & 0 & 0 & 1\\ 0 & 0 & 0 & 0 & 0 & -w_{Nick.w}^2 & 0\end{bmatrix}$$

$$\text{Interference observer matrix: } \underline{H}_{Az}=\begin{bmatrix}h_{11A} & h_{12A} & h_{13A}\\ h_{21A} & h_{22A} & h_{23A}\\ h_{31A} & h_{32A} & h_{33A}\\ h_{41A} & h_{42A} & h_{43A}\\ h_{51A} & h_{52A} & h_{53A}\\ h_{61A} & h_{62A} & h_{63A}\\ h_{71A} & h_{72A} & h_{73A}\end{bmatrix}$$

$$\text{Observer output matrix: } \underline{C}_{mAz}=\begin{bmatrix}1 & 0 & 0 & 0 & 0 & 0 & 0\\ 0 & 1 & 0 & 0 & 0 & 0 & 0\\ 0 & 0 & 0 & 1 & 1 & 0 & 1\end{bmatrix}$$

$$\text{Output vector of the measured values: } \underline{y}_{mA}=\begin{bmatrix}\varphi_A\\ \dot{\varphi}_A\\ \dot{\varphi}_{Srm}\end{bmatrix} \tag{72b}$$

A possible alternative to this is again a reduced model as in the rotating gear. Furthermore, improved offset compensation can be achieved by estimating and eliminating the remaining offset to the angle signal $\hat{\phi}_{Sr}$, by the additional interference variable $\hat{\phi}_{Offset,r}$ and then using the estimated angle signal $\hat{\phi}_{Sr}$ for the condition regulation.

The determination of the observer amplifications $h_{ijD}$ is performed either through transformation into observer normal form or through the design process according to Riccati or pole specification. In this case, it is essential that in the observer also changeable cable length, angle of elevation and load mass be taken into account by adapting the observer differential equation and the observer amplification. From this estimated condition vector $\hat{\underline{x}}_{Az}$, the estimated values $\hat{\phi}_{Sr}$, $\hat{\dot{\phi}}_{Sr}$ are fed back to the condition regulator. In this manner, we receive at the output of the condition regulator block 93 on the feedback of $\phi_A$, $\dot{\phi}_A$, $\hat{\phi}_{Sr}$, $\hat{\dot{\phi}}_{Sr}$ and $\hat{\phi}_{Sr}$ in the case of the two-stage observer (see also FIG. 7*a*), then.

$$u_{Arück}=k_{1A}\phi_A+k_{2A}\dot{\phi}_A+k_{3A}\hat{\phi}_{Sr}+k_{4A}\hat{\dot{\phi}}_{Sr} \tag{73}$$

The desired starting voltage of the proportional valve for the luffing axis is then, taking into account the control 91, analogously to equation 40

$$u_{Aref}=u_{Avorst}-u_{Arück} \tag{74}$$

As in the rotation gear, optional non-linearities of the hydraulics can be compensated for in block 95 of the hydraulic compensation, so that, as a result, a linear system behavior is obtained with respect to the system input. In the luffing gear, in addition to the valve dead stop and the hysteresis, correction factors can be provided for the startup voltage of the angle of elevation $\phi_A$, as well as for the amplification factor $K_{PA}$ and the relevant cylinder diameter $A_{Zyl}$. As a result, a direction-dependent structure conversion of the shaft regulator can be avoided.

For the calculation of the necessary compensation function, the static graph between the startup voltage $U_{StD}$ of the proportional valve and the resulting supply stream $Q_{FD}$ is recorded experimentally. The graphic can be described by a mathematical function.

$$Q_{FA}=f(u_{StA}) \tag{75}$$

With respect to the system input, linearity is required. That is, the proportional valve and the hydraulic compensation block should have the following transfer behavior summarized in equation 47.

$$Q_{FA}=K_{PA}u_{StA} \tag{76}$$

If the compensation block 95 has the static graph $$u_{StA}=h(u_{Aref}) \tag{77}$$

then condition (76) is fulfilled, precisely if $$h(u_{Aref})=f^{-1}(K_{PA}u_{Aref}) \tag{78}$$

is selected as the static compensation graph.

With this, the individual components of the shaft regulator for the luffing gear is explained. As a result, the combination of path planning module and shaft regulator for the luffing gear fulfills the requirement of a swing-free movement of the load precisely on the path when the boom is raised and lowered.

In the above, the fact that, when the rotating gear is actuated, centripetal forces cause the load to be deflected in the radial direction (as on a chain carousel) has not been taken into account.

In the case of rapid braking and acceleration, this effect gives rise to spherical oscillatory movements of the load. In the differential equations 4 and 46, this is expressed by the terms as a function of $\dot{\phi}_D^2$. The oscillatory movements that arise are damped by the condition regulators of rotating gear and luffing gear. An improvement in the precision of the path and compensation for the tendency to swing with respect to radial swings when turning can be achieved by means of a suitable control in a block for compensation for centripetal forces. For this purposes, in the case of a rotational movement, the luffing gear is assigned a compensating movement that compensates for the centripetal effect.

Figure 12:
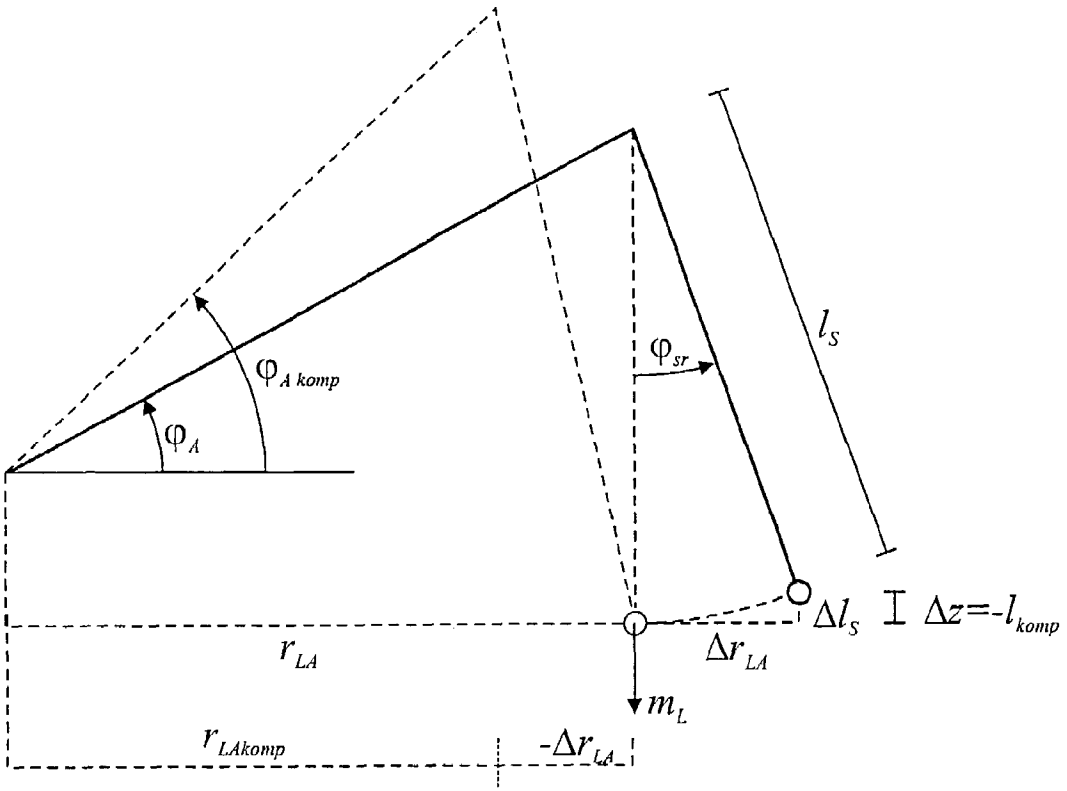
FIG. 12: Structure of the shaft regulator in the case of the lifting gear

In FIG. 12, this effect is represented. Solely rotating the load causes the centripetal force $$F_z = m_L \cdot r_{LA} \dot{\phi}^2_D \tag{78a}$$

a deflection of the swing by the angle $\phi_{Sr}$. The balance condition for the power balance in this case is:

$$m_L \cdot (r_{LA} + \Delta r_{LA}) \dot{\phi}^2_D = m_L \cdot g \cdot \tan\phi_{sr} \tag{78b}$$

The resulting deviation from the path in the radial direction $\Delta r_{LA}$ and in the direction of the lifting gear movement $\Delta z$ can then be described as a function of the radial cable angle $\phi_{Sr}$ by $$\Delta r_{LA} = l_s \cdot \sin\phi_{sr} \tag{78c}$$

The module 150 for compensation for the centripetal form (FIG. 3) now has the task of compensating this deviation as a function of the rotational movement through a simultaneous compensatory movement of the luffing gear and the lifting gear.

Instead of the actual rotational speed of the tower $\dot{\phi}_D$, the desired rotational speed of the load $\dot{\phi}_{Dref}$ generated in the path planning module is used. Depending upon the input for the guide value, now the desired position to be set in the radial direction or the angular position of the boom is calculated from the equations (78 a-c), so that the load position leaves its original radius. The luffing angle $\phi_{A1}$ is used to set the resulting rotational radius of the load to $$R_1 = \cos\phi_{A1} \cdot l_A \tag{78e}$$

The above equations are linearized by setting $\phi_{Sr}=0$. As a result, $\tan\phi_{Sr} \approx \sin\phi_{Sr} \approx \phi_{Sr}$. The resulting radial deviation is then $$\frac{R_1 \dot{\varphi}^2_{Dref}}{g} \cdot l_S = \Delta r_{LA} \tag{78f}$$

The radius of rotation followed by the load is then:

$$R_{ges} = R_1 \left[ 1 + \frac{\dot{\varphi}^2_{Dref}}{g} \cdot l_S \right] \tag{78g}$$

Now the requirement is made that a radius rphd Lakomp is to be maintained, while taking into account the centripetal deviation $r_{LA}$.

$$r_{LAkamp} = \frac{1}{1 + \frac{\dot{\varphi}^2_{Dref}}{g} \cdot l_s} r_{LA} \tag{78h}$$

If the angle position is used as a guide value input for the luffing gear, then, because of equation 78e $$\cos\varphi_{Akamp} = \frac{1}{1 + \frac{\dot{\varphi}^2_{Dref}}{g} \cdot l_s} \cos\varphi_{Aref} \tag{78i}$$

In order to keep the lifting height of the load constant, optionally the lifting of the load can be compensated for by the centripetal force effect by simultaneously starting the lifting gear. With equation (78d), one obtains for this purpose, from the balancing conditions $$\Delta z = l_s \cdot \left( 1 - \cos\left( \arctan\left( \frac{R \dot{\varphi}^2_D}{g} \right) \right) \right) \tag{78j}$$

The values following from the calculation of (78i) and (78j) for the compensation of centripetal force are additionally supplied to the guide value inputs of the shaft regulator.

In addition, a cable deflection for $\phi_{Sr}$, which is then permissible, must be introduced. By pulling the boom upward, the load passes through the desired radius $r_{Laref}$, precisely when the boom is set to a desired radius of $r_{LAAArefkomp}$ and simultaneously a cable pivoting of $$\varphi_{Stzal} = \frac{\dot{\varphi}^2_{Dref} \cdot r_{LArefkomp}}{g - l_S \dot{\varphi}^2_D} \tag{78ja}$$

is permitted. So that the intended cable deflection is not compensated for by the underlying regulation, it is input weighted with $k_{3A}$.

The above relationships are based on a stationary regard, which can be applied in the case of low rotating acceleration. If very high rotational accelerations arise, a dynamic model application is selected for the control compensation.

The oscillatory movement of the load can be described, taking centrifugal force into account through the following differential equation, where the effect on swinging $\ddot{\phi}_A$ is purposely not taken into account here, because we are aiming exclusively on the effects of centrifugal force alone.

$$m_L l_2^2 \cdot \ddot{\phi}_{Srz} = F_Z \cdot l_S \cdot \cos\phi_{Srz} - mg \cdot l_S \cdot \sin\phi_{Srz} \tag{78jb}$$

With $$F_z = (\sin\phi_{Srz} l_S + l_A \cos\phi_A) m_L \cdot \dot{\phi}_D^2$$

one obtains $$\ddot{\varphi}_{Srz} = \left( \sin\varphi_{Srz} + \frac{l_A}{l_S} \cos\varphi_A \right) \dot{\varphi}^2_D \cdot \cos\varphi_{Srz} - \frac{g}{l_S} \sin\varphi_{Srz} \tag{78jc}$$

$\phi_{Srz}$ is the cable angle resulting from centrifugal force. After linearizing by $\phi_{Srz}=0$ and ignoring the term $\phi_S \cdot \dot{\phi}_D^2$ opposite $$\frac{l_A}{l_S} \cos\varphi_A \cdot \dot{\varphi}^2_D,$$

on obtains $$\ddot{\varphi}_{Srz} = \frac{l_A}{l_S} \cos\varphi_A \ \dot{\varphi}^2_D - \frac{g}{l_S} \varphi_{Srz} \tag{78jd}$$

Equation 78jd is a differential equation for an undamped swinging, which is stimulated from the outside through $$\frac{l_A}{l_S}\cos\varphi_A \cdot \dot{\varphi}_D^2.$$

This has the natural frequency of $$\sqrt{\frac{g}{l_S}}.$$

For the radius compensation, one is interested only in the trend of the deviation, since the oscillation is damped by the underlying luffing gear regulator. The luffing gear regulator is set so that it can be set equal to the damping coefficient $d_R$ in the above differential equation. This is inserted in equation 78jd. The result is the following transfer function in the frequency range:

$$\varphi_{Srz}(s) = \frac{\frac{l_A}{l_S}\cos\varphi_A}{s^2 + 2\sqrt{\frac{g}{l_S}} \cdot d_R \cdot s + \frac{g}{l_S}}\dot{\varphi}_D^2(s) \tag{78je}$$

or $$\ddot{\varphi}_{Srz} = \frac{g}{l_S}\varphi_{Srz} - 2\sqrt{\frac{g}{l_S}} \cdot d_R \cdot \dot{\varphi}_{Srz} + \frac{l_A}{l_S}\cos\varphi_A \cdot \dot{\varphi}_D^2 \tag{78jf}$$

in the time range. This differential range can now be simulated with the measured value $\dot{\phi}_D^2$ or the desired value $\dot{\phi}_{Dref}^2$ as an input during crane operation. It provides the cable angle to be expected, as a result of centrifugal force, while the measured values of the cable length $l_S$ and angle of elevation $\phi_A$ are always followed.

The radius deviation $\Delta r_{LA}$ which arises is then $$\Delta r_{LA} = l_S \sin\phi_{Srt}$$

and therefore $$r_{LAkomp} = r_{LAref} - l_S \sin\phi_{Srz}.$$

The higher derivatives are formed correspondingly. The simulated angle $\phi_{Srz}$ determined by centrifugal force is supplied to the second input, weighted with $k_{3A}$ as compensation.

Furthermore, in order to deal with the problem, especially that of coupling of the differential equations 4 and 46, the process of flatness-based control and regulation modified on the basis of non-linear equations is applicable. The structure of equations 4 and 46 can be written as $$a_0\ddot{\phi}_D + a_1\ddot{\phi}_{St} + a_2\dot{\phi}_D = M_D \tag{78k}$$

$$a_3\ddot{\phi}_D + a_4\ddot{\phi}_{St} + a_5\phi_{St} = a_6\dot{\phi}_D^2\phi_{St} \tag{78l}$$

$$b_0\ddot{\phi}_A + b_1\ddot{\phi}_{Sr} + b_2\dot{\phi}_A = M_A \tag{78m}$$

$$b_4\ddot{\phi}_A + b_5\ddot{\phi}_{Sr} + b_6\phi_{Sr} = b_7\dot{\phi}_D^2\phi_{Sr} \tag{78n}$$

Now equations 78k and 78m can be solved for $\ddot{\phi}_{St}$ or $\ddot{\phi}_{Sr}$. This provides $$\ddot{\varphi}_{Sr} = \frac{1}{a_1}(M_D - a_0\ddot{\varphi}_D - a_2\dot{\varphi}_D) \tag{78o}$$

$$\ddot{\varphi}_{Sr} = \frac{1}{b_1}(M_A - b_0\ddot{\varphi}_A - b_2\dot{\varphi}_A) \tag{78p}$$

In equations 78l through 78n, equation 78o and 78p are inserted. Then these equations can be transformed into the moment to be applied.

$$M_D = \frac{a_1}{a_4}(a_6\dot{\varphi}_D^2\varphi_{St} - a_5\varphi_{St} - a_3\ddot{\varphi}_D) + a_0\ddot{\varphi}_D + a_2\dot{\varphi}_D \tag{78q}$$

$$M_A = \frac{b_1}{b_5}(b_7\dot{\varphi}_D^2\varphi_{Sr} - b_6\varphi_{Sr} - b_4\ddot{\varphi}_A) + b_0\ddot{\varphi}_A + b_2\dot{\varphi}_A \tag{78r}$$

Equations 78q and 78r now provide contexts for the desired moment as a function of the conditions values. If now, instead of the rotational angle or the angle of elevation, the desired angle of rotation or desired angle of elevation in equations 78q and 78r and the measured current cable angle $\phi_{St}$ and $\phi_{Sr}$ are used, a linear follower regulator can be defined (see also A. Isidori: Nonlinear Control Systems, 2nd Edition, Springer Publishing House Berlin; Rothfuss R. et al.: Flatness: A New Approach to Control and Regulation, Automation Technology November 1997 pages 517-525). The representation becomes $$M_D = \frac{a_1}{a_4}(a_6\dot{\varphi}_{Dref}^2\varphi_{St} - a_5\varphi_{St} - a_3 v_1) + a_0 v_1 + a_2\dot{\varphi}_{Dref} \tag{78s}$$

$$M_A = \frac{b_1}{b_5}(b_7\dot{\varphi}_{Dref}^2\varphi_{Sr} - b_6\varphi_{Sr} - b_4 v_2) + b_0 v_2 + b_2\dot{\varphi}_{Aref} \tag{78t}$$

with $$v_1 = \ddot{\phi}_D - P_{10}(\phi_D - \phi_{Dref}) - P_{11}(\dot{\phi}_D - \dot{\phi}_{Dref}) \tag{78u}$$

$$v_2 = \ddot{\phi}_A - P_{20}(\phi_A - \phi_{Dref}) - P_{21}(\dot{\phi}_A - \dot{\phi}_{Dref})$$

$P_{10}, P_{11}, P_{20}, P_{21}$ are to be selected in such a manner that the regulation works with high dynamics at sufficient damping.

A further possibility for treating the non-linearity, in addition to the two processes illustrated, consists of the method of exact linearization as well as decoupling of the system. In the present case, this can be achieved only incompletely, since the system does not possess complete differential order. Nevertheless, a regulator can be used based on this process.

Figure 13:
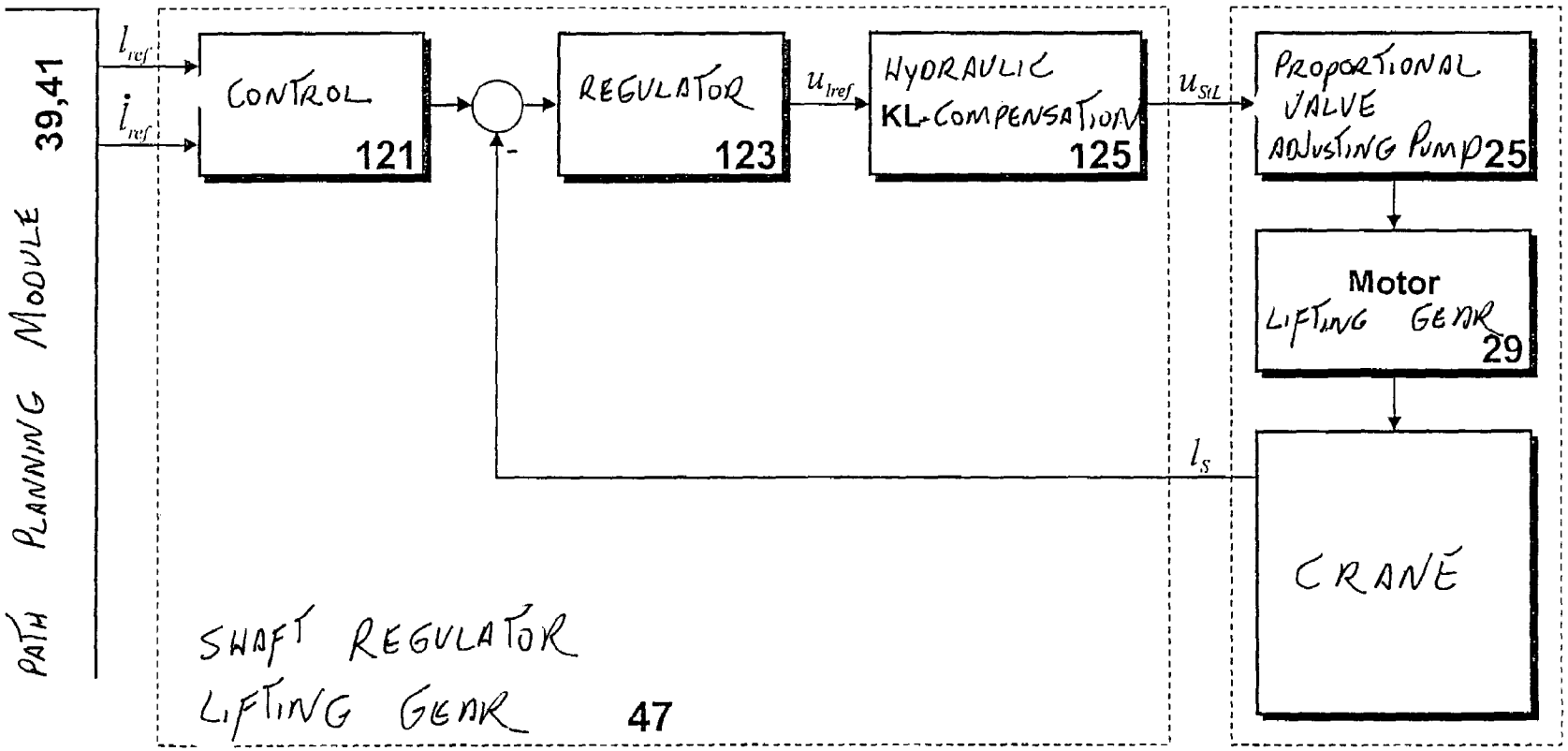
FIG. 13: Structure of the shaft regulator in the case of the load traversing gear

Finally, the structure of the shaft regulator for the lifting gear should be explained. The structure of the shaft regulator is represented in FIG. 13. In contrast to the shaft regulators for the rotating gear 43 and the luffing gear 45, the shaft regulator for the lifting gear 47, since this shaft shows only a minor tendency to swing, is equipped with a standard cascade regulation with an outside regulating loop for the position and an inside one for speed.

Only the time functions desired position of the lifting gear $l_{ref}$ and the desired speed $l_{ref}$ are needed by the path planning module 39 or 41 to start the shaft regulator. These are weighted in a control block 121 in such a manner that a rapid response and a stationarily precise positioning system behavior results. Since the desired-actual comparison between the guide value $l_{ref}$ and the measured value $I_S$ takes place directly behind the control block, the stationary requirement with respect to position is fulfilled if the control amplification for the position is 1. The control amplification for the desired speed $l_{ref}$ is to be determined in such a manner that subjectively a rapid but well damped response results from using the manual lever. The regulator 123 for the position regulating loop can be designed as a proportional regulator (P regulator). The regulation amplification is to be determined according to the criteria of stability and sufficient damping of the closed regulating circuit. The beginning value of the regulator 123 is the ideal start voltage of the proportional valve. As in the case of the shaft regulators for the rotating gear 43 and the luffing gear 45, the non-linearities of the hydraulics are compensated for in a compensation block 125. The calculation is done as in rotation (equations 42-44). The beginning value is the correct starting voltage of the proportional valve $U_{StL}$. The internal regulating loop for the speed is the underlying supply flow regulation of the hydraulic circuit.

The last direction of movement is the swiveling of the load on the load hook itself by the load swiveling gear. A corresponding description of this regulation is given in the German Patent Application DE 100 29 579 of Jun. 15, 2000, to the content of which express reference is made. The rotation of the load is undertaken using the load swiveling gear between a lower block and hanging from the cable and a load lifting device. At the same time, torsion oscillations are suppressed. As a result, the load, which in most cases is not rotationally symmetrical, can be lifted, moved through a corresponding narrow aperture and deposited. Obviously, this direction of motion is also integrated into the path planning module as is represented as an example using the overview in FIG. 3. In an especially advantageous manner, the load can, after being picked up during transport through the air, be swiveled into the correspondingly desired position using the load swiveling gear, where here the individual pumps and motors are controlled synchronously. Optionally, a mode can be selected for an orientation independent of the angle of rotation.

In summary in the sample embodiment represented here, there results a mobile port crane whose path control allows the load to travel precisely on path with all axes and at the same time actively suppresses swinging and oscillatory movement.

Especially for the semi-automatic operation of a crane or excavator, it may be sufficient, in connection with this invention, if only the position and speed functions are used in the controls. This leads to a subjectively quieter behavior. It is, therefore, not necessary to generate all values of the dynamic model down to the derivation of the jerk which are to be used for the active damping of the load swings.

The invention claimed is:

1. A crane for traversing a load hanging on a load cable, which comprises:

a rotating mechanism (1) for rotating the crane, a luffing mechanism (7) for elevating and lowering a jib (5), a lifting mechanism for raising and lowering the load (3) hanging on the load cable, and a computer-based control system (31) for damping the oscillations of the load including a path planning module (39), a centripetal force compensating device (150) and at least one axis controller (43) for the rotating mechanism, an axis controller (45) for the luffing mechanism, and an axis controller (47) for the lifting mechanism, wherein the angle of oscillation and the speed of oscillation of the load ($\phi_{St}$, $\dot{\phi}_{St.}$, $\phi_{Sr.}$, $\dot{\phi}_{Sr}$) are calculated from gyroscopic signals from at least one gyroscope, wherein the path of the load in the working space is generated in the path planning module and is passed on to a respective axis controller in the form of a time function for the load position, speed, acceleration of the jerk and derivative of the jerk, and further including a mechanical system and hydraulic system, wherein each axis controller includes a feed-forward control unit in which the dynamic behavior of the mechanical system and hydraulic system is depicted in an idealized dynamic model, and a state control unit in which deviations from the idealized dynamic model of the feed forward control are registered.

2. Crane according to claim 1, wherein, in addition, between a lower block of the load cable and a load carrying means, a load swiveling gear is provided and the regulation for damping of the load swings has an additional shaft regulator, which is in communication with the path planning module.

3. Crane according to claim 2, wherein, the shaft regulator for the lifting gear has a cascade regulation with an outside regulating loop for the position and an inside regulating loop for the speed.

4. Crane according to claim 2, wherein, in the path planning module, first the path of the load is generated in the working space and is forwarded in the form of a time function for load position, speed, acceleration, and jerk, to each of the shaft regulators.

5. Crane according to claim 1, wherein, in the path planning module, first the path of the load in a working space is generated and forwarded in the form of time function for the load position, speed, acceleration, and jerk, to each of the shaft regulators.

6. Crane according to claim 5, wherein, the shaft regulator for the lifting gear has a cascade regulation with an outside regulating loop for the position and an inside regulating loop for the speed.

7. Crane according to claim 5, wherein, each of the shaft regulators has a control unit in which, based on a dynamic model on the basis of differential equations, the dynamic behavior of the mechanical and hydraulic system of the crane is portrayed, so that control values used for the active damping of the load swings are generated.

8. Crane according to claim 3, wherein, the shaft regulator for the lifting gear has a cascade regulation with an outside regulating loop for the position and an inside regulating loop for the speed.

9. Crane according to claim 7, wherein, the regulation additionally includes a condition regulator unit in which actual deviations from an idealized dynamic model of the control are detected.

10. Crane according to claim 9, wherein, the shaft regulator for the lifting gear has a cascade regulation with an outside regulating loop for the position and an inside regulating loop for the speed.

11. Crane according to claim 9, wherein, in the condition regulator unit at least one of the measured values selected from angle swing in radial direction ($\phi_{Sr}$), angle swing in tangential direction ($\phi_{St}$), angle of elevation ($\phi_A$), angle of rotation ($\phi_D$), cable length ($I_S$), boom bending in the horizontal and vertical direction, as well as their derivatives and the load mass are fed back.

12. Crane according to claim 11, wherein, the shaft regulator for the lifting gear has a cascade regulation with an outside regulating loop for the position and an inside regulating loop for the speed.

13. Crane according to claim 7, wherein, only the position and speed function are used as control values for the active damping of load swings.

14. Crane according to claim 13, wherein, additionally the acceleration function and the jerk function are also used in the control.

15. Crane according to claim 1, wherein, interference in measurement signals of said at least one gyroscope in an interference observer module are estimated and compensated for.

16. Crane according to claim 15, wherein, the shaft regulator for the lifting gear has a cascade regulation with an outside regulating loop for the position and an inside regulating loop for the speed.

17. Crane according to claim 1, wherein, in the path planning module, the path of the load is generated for a semi-automatic operation proportional to the displacement of a manual lever and in fully automatic operation, the path of the load is generated corresponding to destination coordinates.

18. Crane according to claim 17, wherein, in the path planning module, said semi-automatic operation comprises: a first rate of change of movement steepness limiter block of the second order for normal operation and a second rate of change of movement steepness limiter block of the second order for quick stop.

19. Crane according to claim 1, wherein, the shaft regulator for the lifting gear has a cascade regulation with an outside regulating loop for the position and an inside regulating loop for the speed.

20. Crane according to claim 1, comprising a drive system having proportional valves governed by control voltages wherein the time functions of the control voltages are calculated in the path control regulation system (31) in such a manner that upon moving the crane, no swing motions of the load arise and the load follows a desired path in the working space.

21. The crane of claim 20 wherein the drive system is an hydraulic system.

22. The crane of claim 20 wherein path control regulation system is provided for damping the angle and speed of oscillations of the load swings, said angle and speed of oscillations being calculated from gyroscopic signals provided by at least one gyroscope.

23. The crane of claim wherein a load swivelling mechanism is arranged between a bottom block of the load cable and a load-lifting means, and the control system additionally includes an axis controller for damping the oscillation of the load, which is connected to the path planning module.

24. The crane of claim 1 wherein the path of the load in the working space is generated in the path planning module and is passed on to a respective axis controller in the form of a time function for the load position, speed, acceleration of the jerk and derivative of the jerk.

25. The crane of claim 24 further including a mechanical system and hydraulic system, wherein each axis controller includes a feed-forward control unit in which the dynamic behavior of the mechanical system and hydraulic system is depicted in an idealized dynamic model.

26. The crane of claim 25, wherein only position and speed functions are used as control variables for the active damping of the load oscillations.

27. The crane of claim 26, wherein acceleration function and jerk functions are also used as control variables.

28. The crane of claim 1 wherein in the state control unit at least one of the variables comprising angle swing in radial direction ($\phi_{Sr}$), angle swing in tangential direction ($\phi_{St}$), angle of elevation ($\phi_A$), angle of rotation ($\phi_D$), cable length ($I_S$), boom bending in the horizontal and vertical direction, as well as their derivatives and the load mass, are fed back.

29. The crane of claim 1 wherein a path of the load for semi-automatic operation is generated proportional to the deflection of a hand lever, and wherein in fully automatic operation target coordinates corresponding to the path of the load are generated.

30. The crane of claim 29 wherein in semi-automatic operation the path planning module (39) includes a slope limiter of second order for normal operation and a slope limiter of second order for a rapid stop.

31. A crane for traversing a load hanging on a load cable, which comprises:

a rotating mechanism (1) for rotating the crane, a luffing mechanism (7) for elevating and lowering a jib (5), a lifting mechanism for raising and lowering the load (3) hanging on the load cable, and a computer-based control system (31) for damping the oscillations of the load including a path planning module (39), a centripetal force compensating device (150) and at least one axis controller (43) for the rotating mechanism, an axis controller (45) for the luffing mechanism, and an axis controller (47) for the lifting mechanism, wherein the angle of oscillation and the speed of oscillation of the load ($\phi_{St.}$, $\dot{\phi}_{St.}$, $\phi_{Sr.}$, $\dot{\phi}_{Sr}$) are calculated from gyroscopic signals from at least one gyroscope, and disturbances in the measured signal from the gyroscope are estimated and compensated for in a disturbance observer.

32. A crane for traversing a load hanging on a load cable, which comprises:

a rotating mechanism (1) for rotating the crane, a luffing mechanism (7) for elevating and lower a jib (5), a lifting mechanism for raising and lowering the load (3) hanging on the load cable, and a computer-based control system (31) for damping the oscillations of the load including a path planning module (39), a centripetal force compensating device (150) and at least one axis controller (43) for the rotating mechanism, an axis controller (45) for the luffing mechanism, and an axis controller (47) for the lifting mechanism, wherein the angle of oscillation and the speed of oscillation of the load ($\phi_{St.}$, $\dot{\phi}_{St.}$, $\phi_{Sr.}$, $\dot{\phi}_{Sr}$) are calculated from gyroscopic signals from at least one gyroscope, and the axis controller (47) for the lifting mechanism has a cascade control system having an outer control loop for position and an inner control loop for speed.

* * * * *